US006919855B2

(12) United States Patent
Hills

(10) Patent No.: US 6,919,855 B2
(45) Date of Patent: Jul. 19, 2005

(54) TUNED PERTURBATION CONE FEED FOR REFLECTOR ANTENNA

(75) Inventor: Chris Hills, Fife (GB)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 10/605,262

(22) Filed: Sep. 18, 2003

(65) Prior Publication Data

US 2005/0062663 A1 Mar. 24, 2005

(51) Int. Cl.[7] ..... H01Q 19/19; H01Q 19/12
(52) U.S. Cl. ..... 343/781 CA; 343/840
(58) Field of Search ..... 343/781 CA, 784, 343/785, 792.5, 840, 872

(56) References Cited

U.S. PATENT DOCUMENTS 4,963,878 A 10/1990 Kildal ..... 343/781 P
5,959,590 A 9/1999 Sanford et al. ..... 343/781 P
5,973,652 A 10/1999 Sanford et al. ..... 343/781 P
6,020,859 A * 2/2000 Kildal ..... 343/781 CA
6,137,449 A * 10/2000 Kildal ..... 343/781 P
6,429,826 B2 8/2002 Karlsson et al. ..... 343/781 P
6,456,253 B1 * 9/2002 Rummeli et al. ..... 343/839
6,731,249 B1 * 5/2004 Gau et al. ..... 343/840

* cited by examiner

*Primary Examiner*—Wilson Lee
*Assistant Examiner*—Minh Dieu A
(74) *Attorney, Agent, or Firm*—Babcock IP, LLC

(57) ABSTRACT

A sub-reflector for a dish reflector antenna with a waveguide supported sub-reflector. The sub-reflector formed from a dielectric block, concentric about a longitudinal axis. The dielectric block having a first diameter waveguide junction portion adapted for coupling to an end of the waveguide and a sub-reflector surface coated with an RF reflective material having a periphery with a second diameter larger than the first diameter. A leading cone surface extends from the waveguide junction portion to the second diameter at an angle. The sub-reflector surface and the leading cone surface having a plurality of non-periodic perturbations concentric about the longitudinal axis.

22 Claims, 25 Drawing Sheets

Figure 1a Prior Art Cone Design
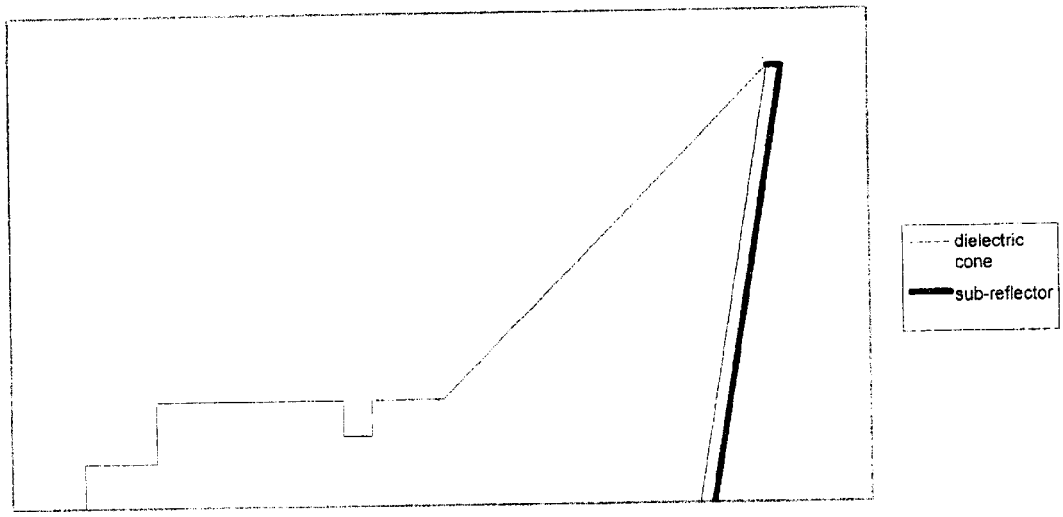
Figure 1b: Etheta and EPhi Amplitude Radiation Patterns from Prior Art Cone Feed (F/D=0.37 typ)
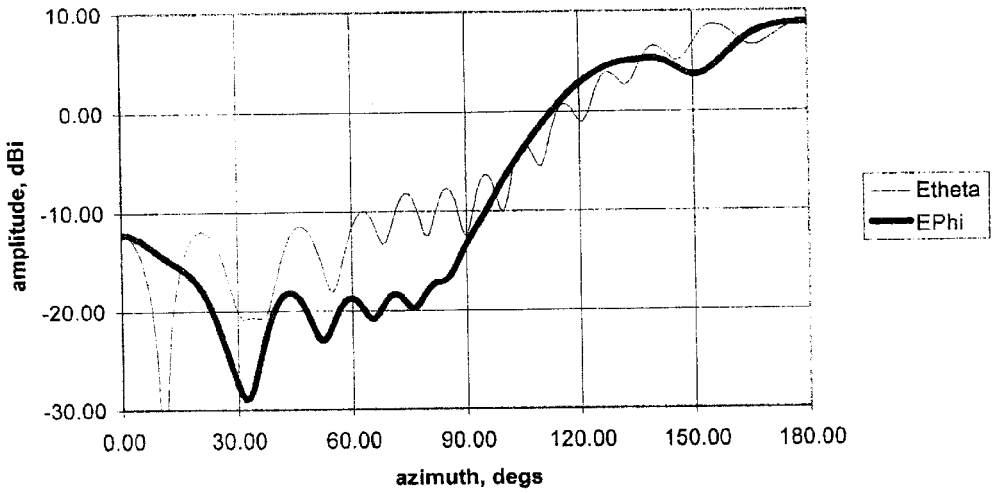

Figure 1c: Etheta and Ephi Phase Patterns from Prior Art Cone Feed (F/D=0.37 typ)
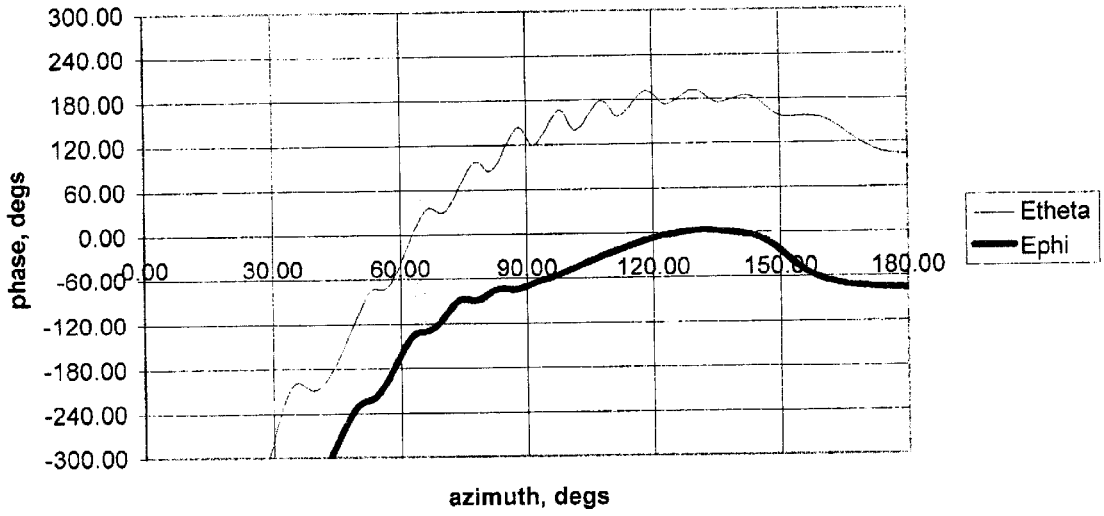

Figure 2a: Prior Art Cone Design (F/D<0.2) typ.
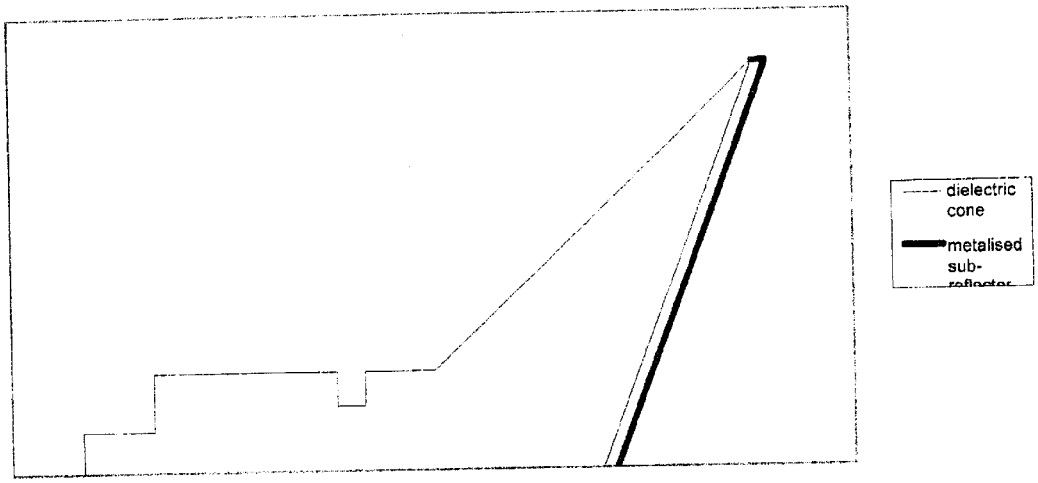
Figure 2b: Etheta and EPhi Amplitude Radiation Patterns from Prior Art Cone Feed (F/D< 0.2 typ)
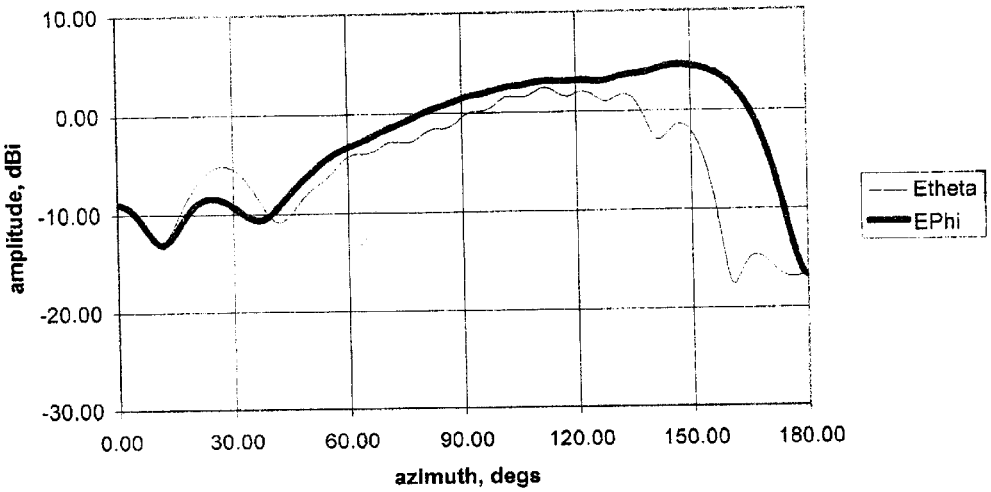

Figure 2c: Etheta and Ephi Phase Patterns from Prior Art Cone Feed (F/D<0.2 typ)
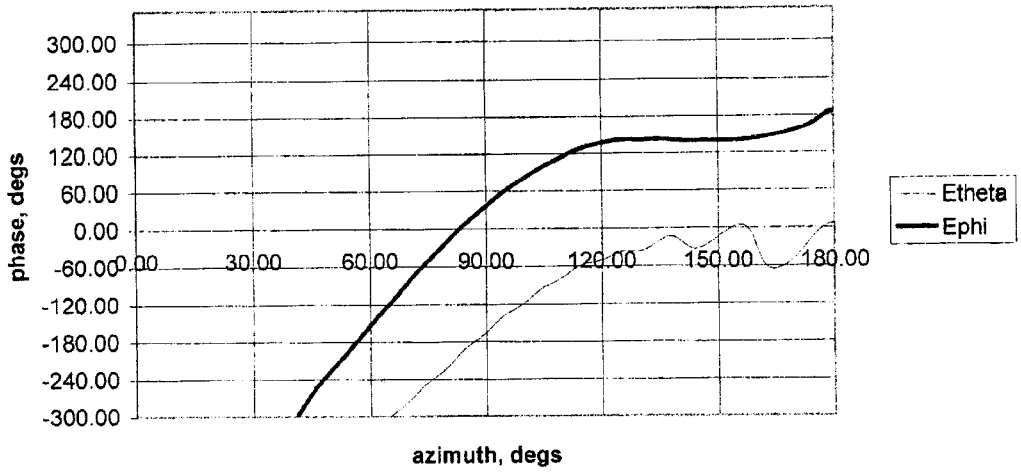
Figure 3a: Prior Art Corrugated Cone Design (F/D<0.2) typ.
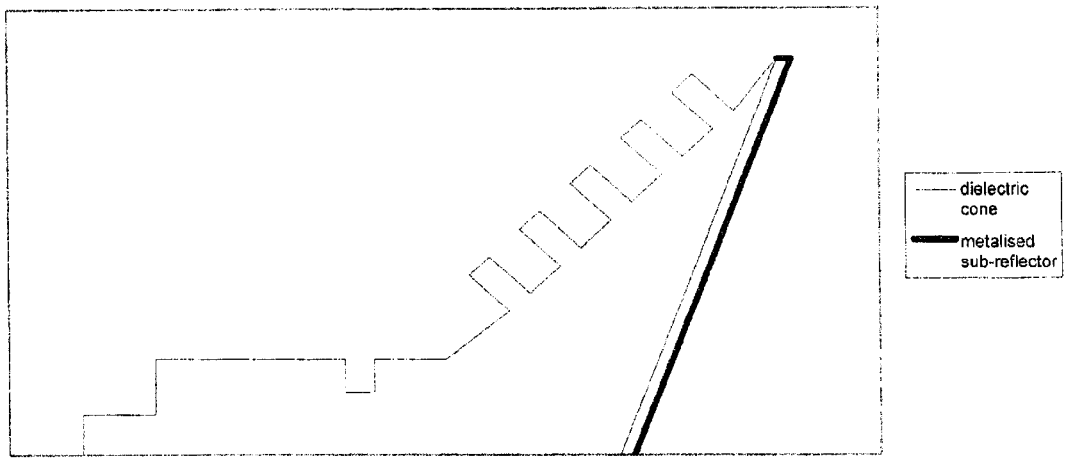

Figure 3b: Etheta and EPhi Amplitude Radiation Patterns from Prior Art Corrugated Cone Feed (F/D< 0.2 typ)
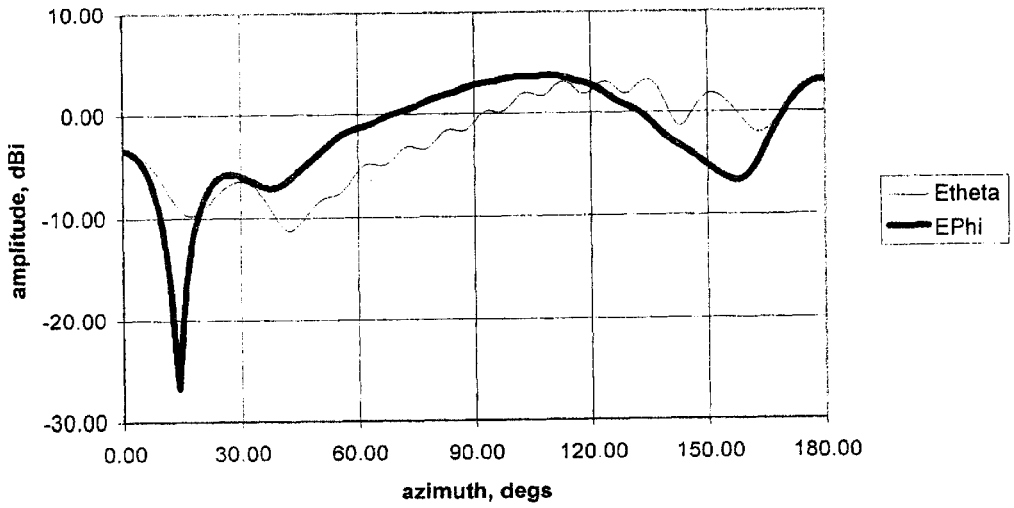
Figure 3c: Etheta and Ephi Phase Patterns from Prior Art Corrugated Cone Feed (F/D<0.2 typ)
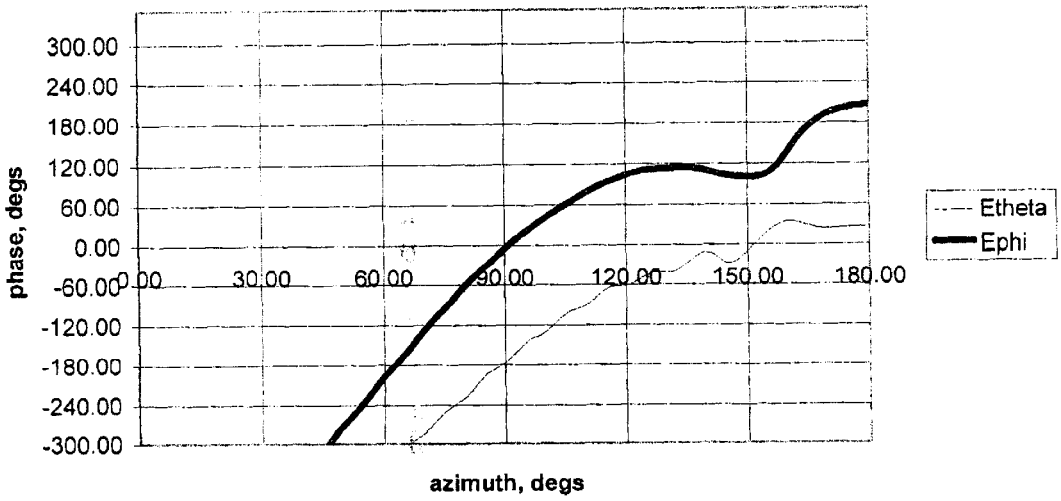

Figure 6a: 22GHz 1' Measured Radiation Pattern of First Embodiment: E-plane vs ETSI and FCC specs
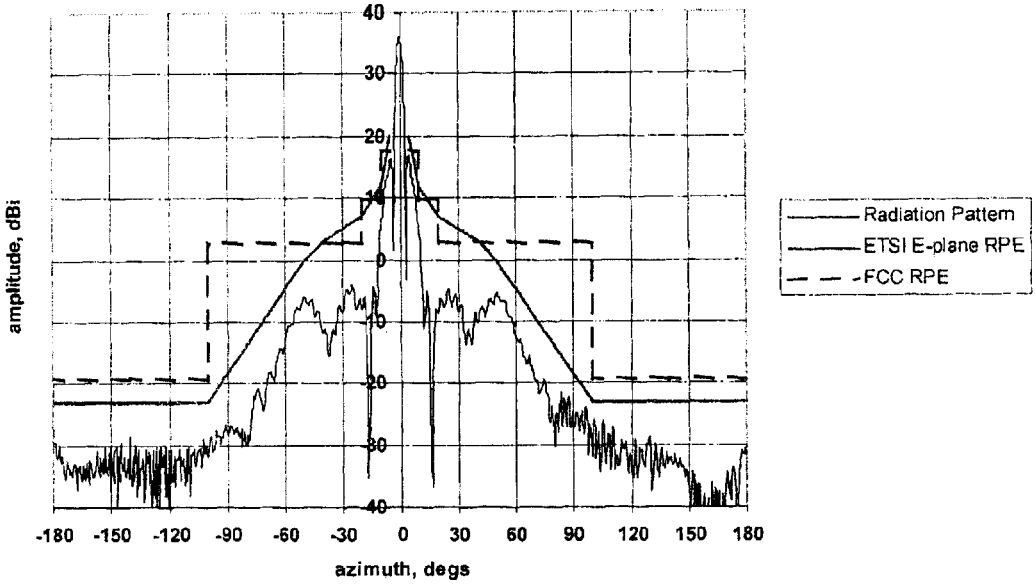
Figure 6b: 22GHz 1' Measured Radiation Pattern of First Embodiment: H-plane vs ETSI and FCC specs
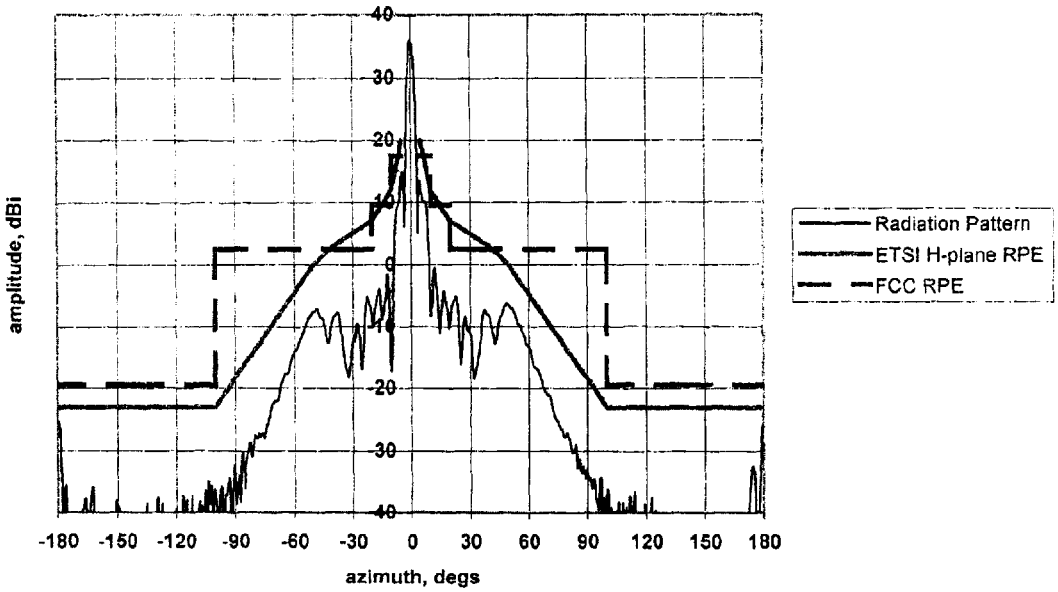

Figure 7 of First Embodiment: Measured vs Modelled Return Loss of Cone Feed
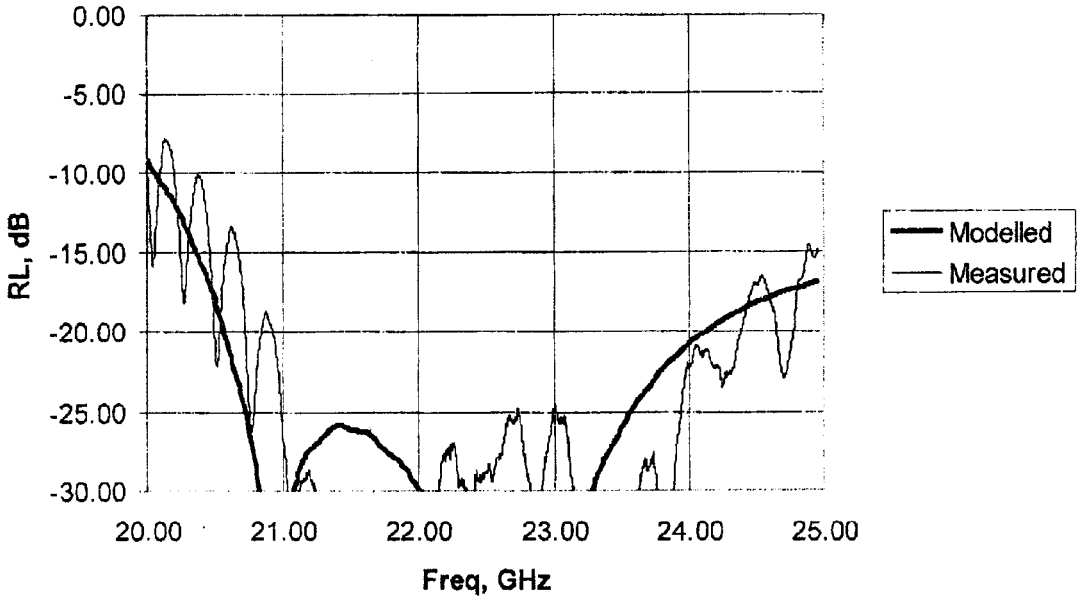

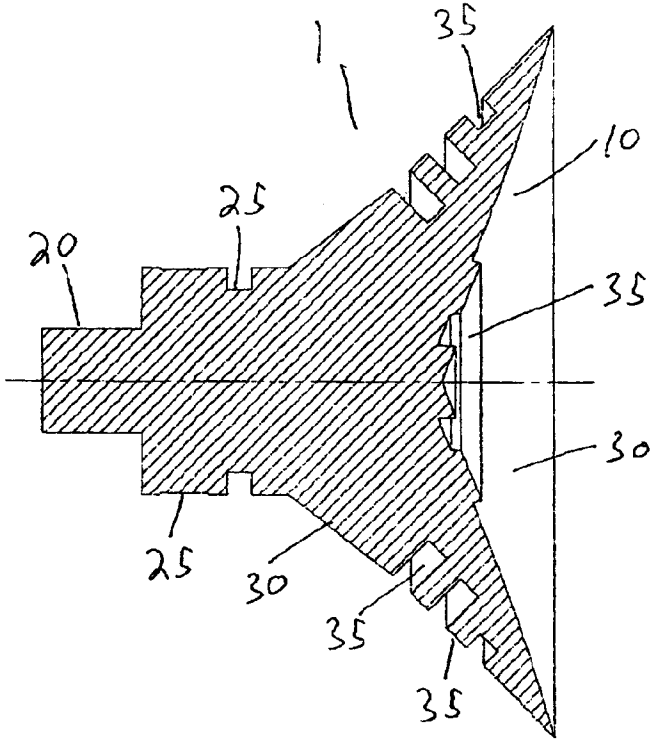
Fisure 8e
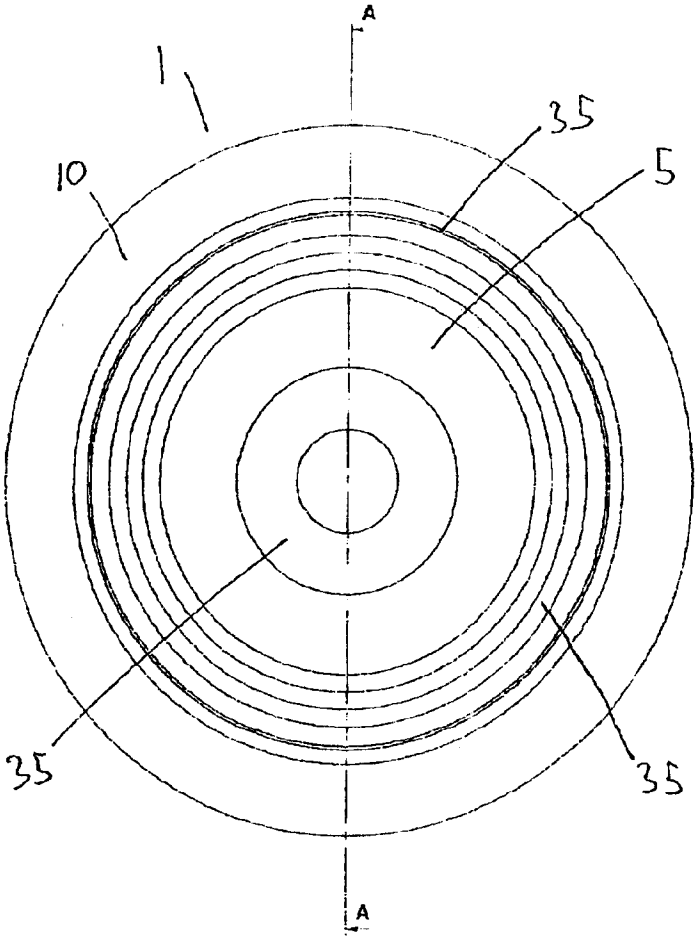
Fisure 8d

Figure 9a: 22GHz 1' Measured Radiation Pattern of Second Embodiment: E-plane vs ETSI and FCC specs
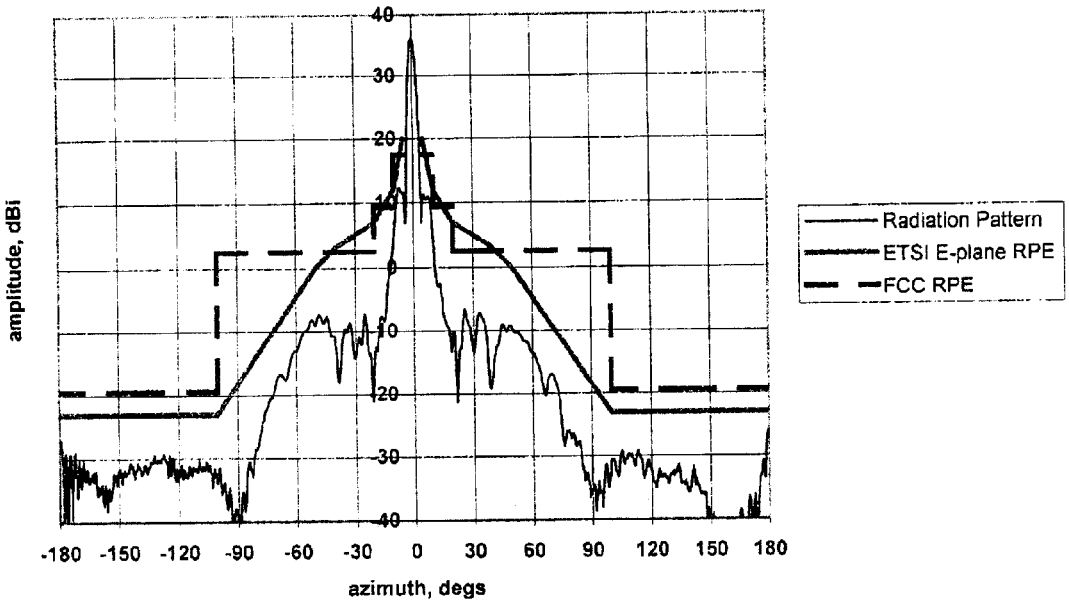
Figure 9b: 22GHz 1' Measured Radiation Pattern of Second Embodiment: H-plane vs ETSI and FCC specs
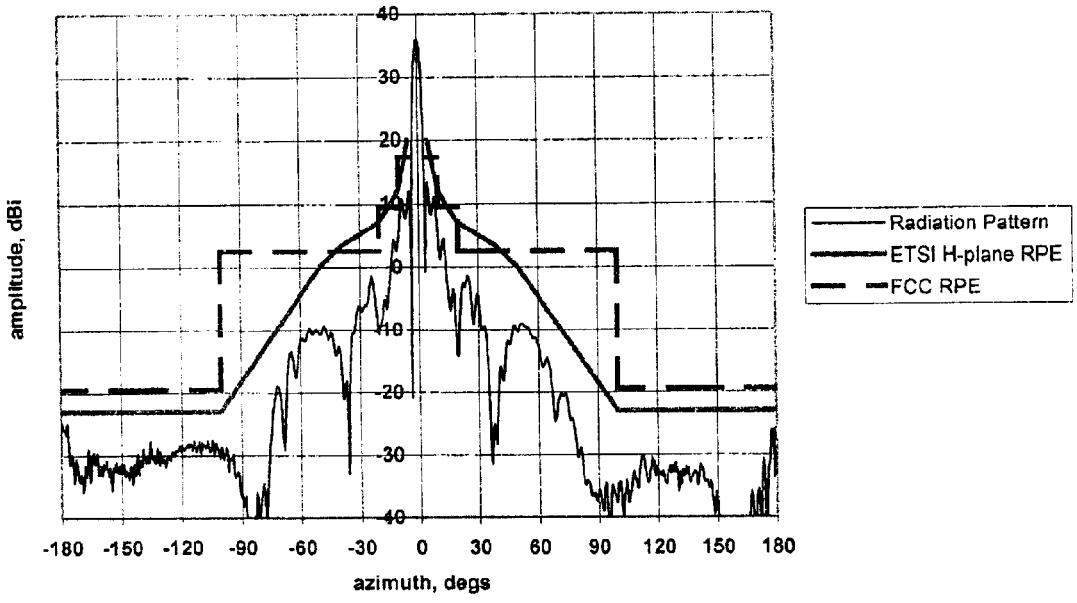

Figure 10a: 3rd Embodiment (F/D<0.2) typ.
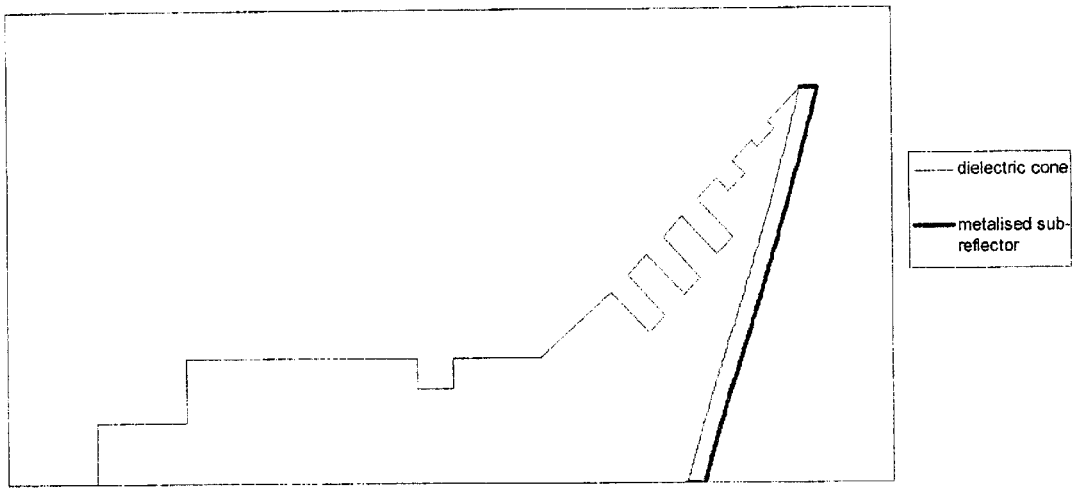
Figure 10b: Etheta and EPhi Amplitude Radiation Patterns
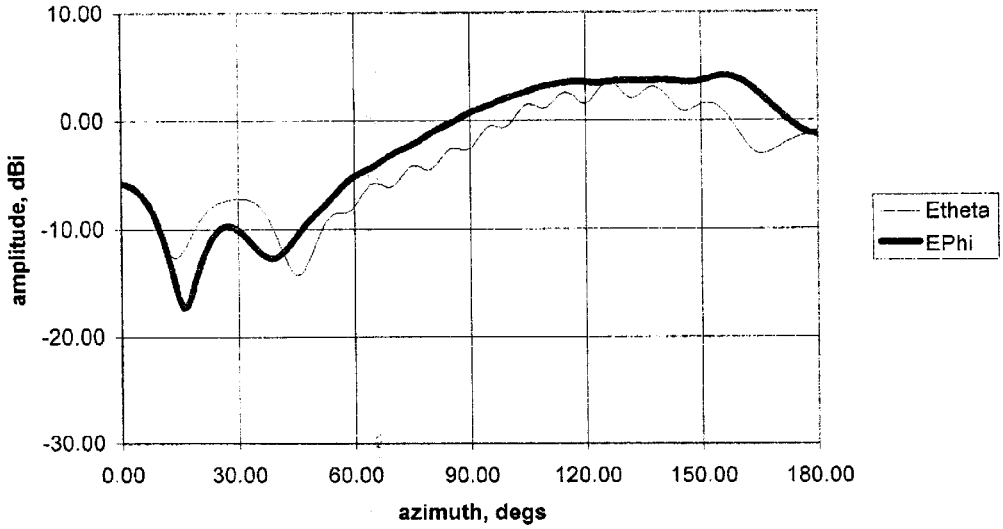

Figure 10c:Etheta and Ephi Phase Patterns (F/D<0.2 typ)
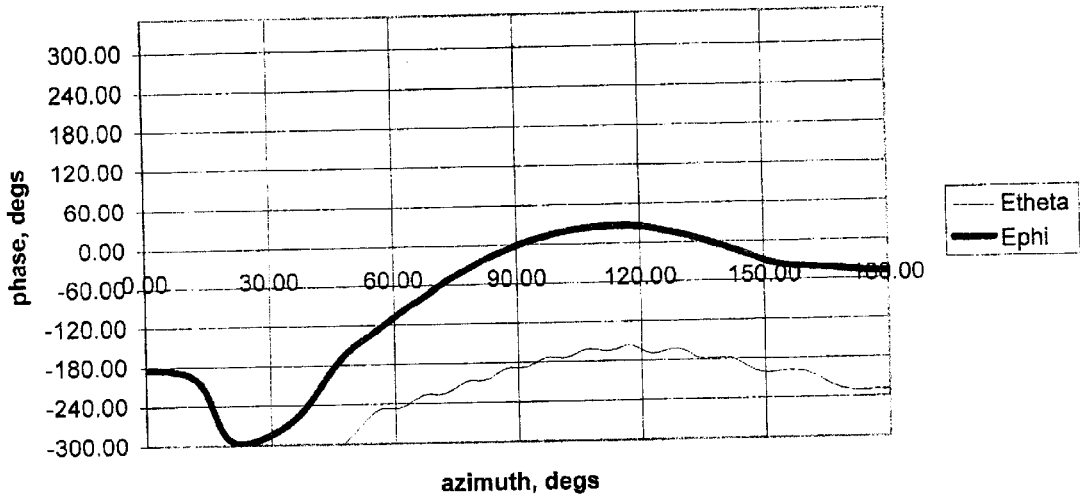
Figure 11a: 4th Embodiment (F/D<0.2) typ.
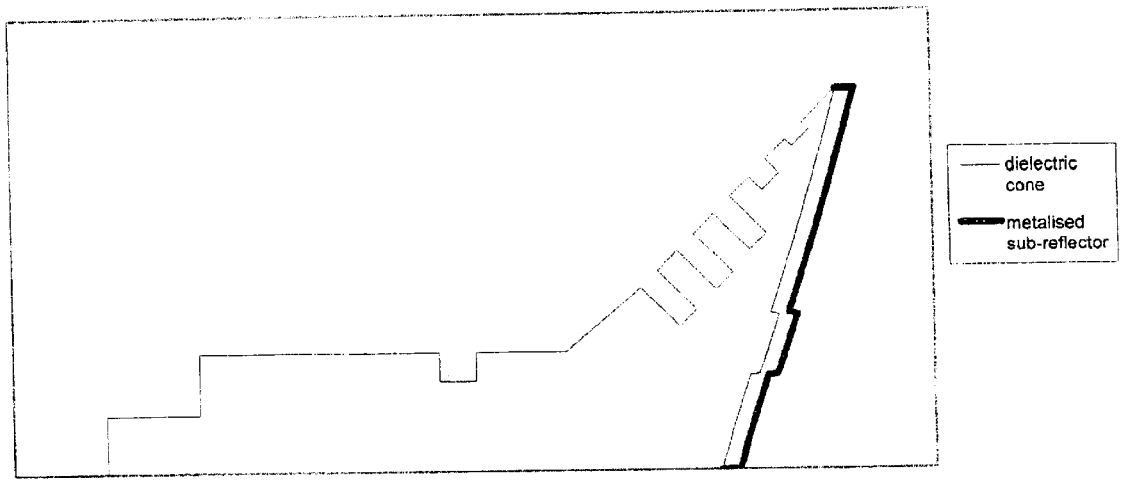

Figure 11b: Etheta and EPhi Amplitude Radiation Patterns
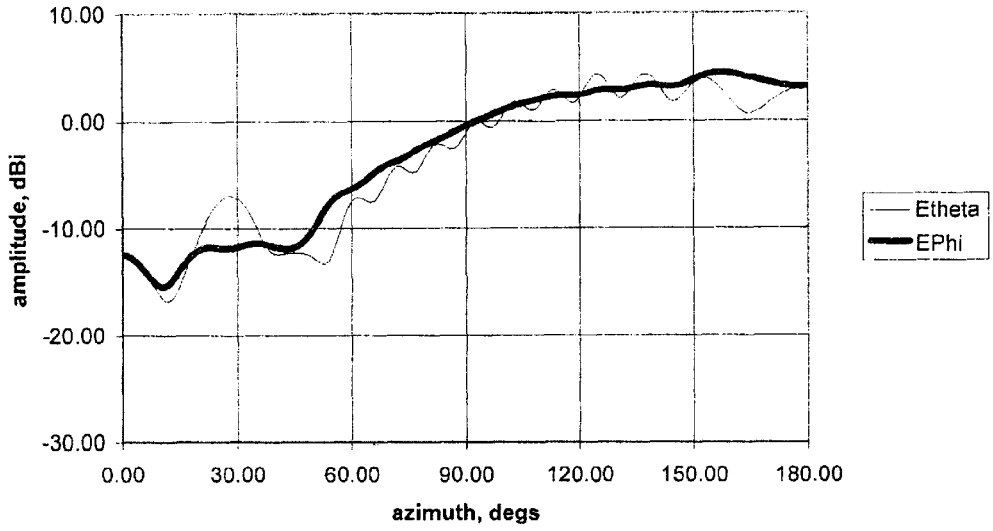
Figure 11c: Etheta and Ephi Phase Patterns
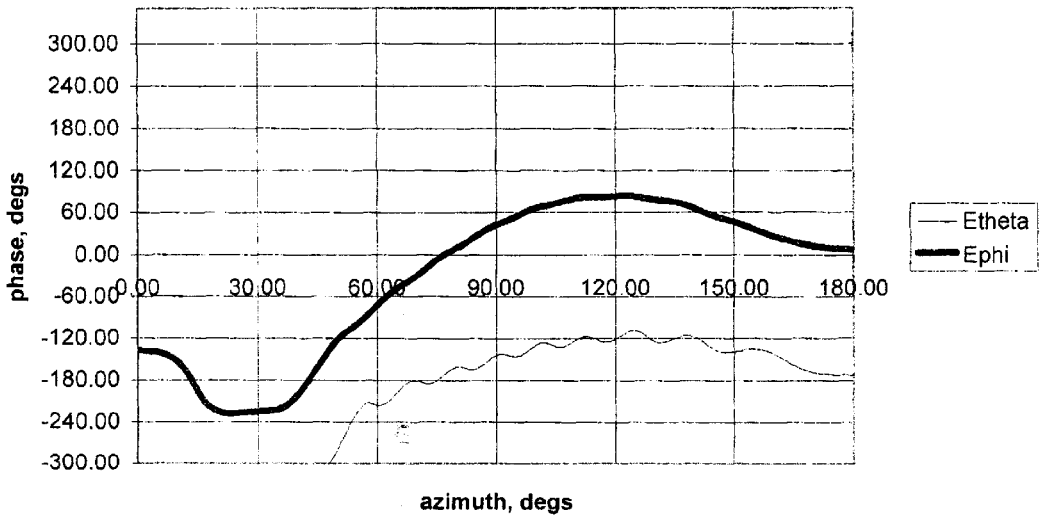

Figure 12a: 5th Embodiment (F/D<0.2) typ.
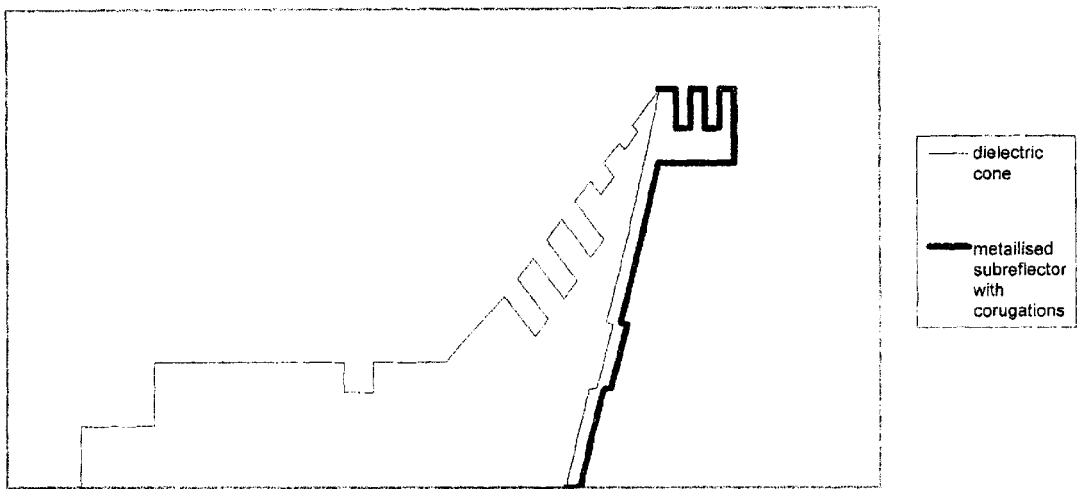
Figure 12b: Etheta and EPhi Amplitude Radiation Patterns
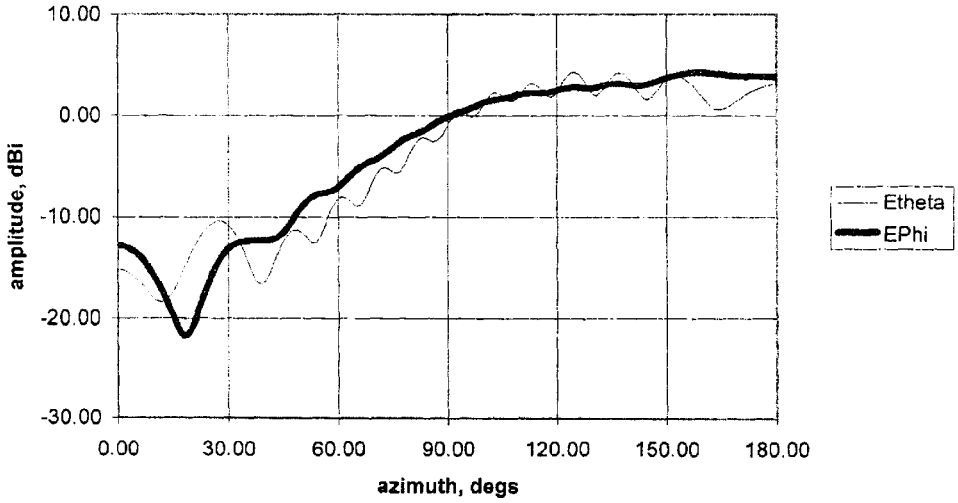

Figure 12c: Etheta and Ephi Phase Patterns
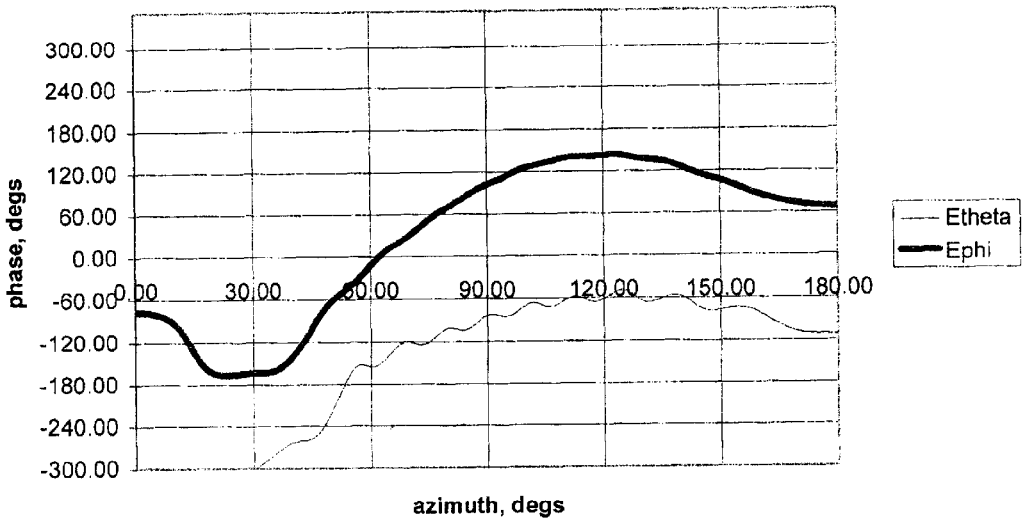
Figure 13a: 6th Embodiment (F/D<0.2) typ.
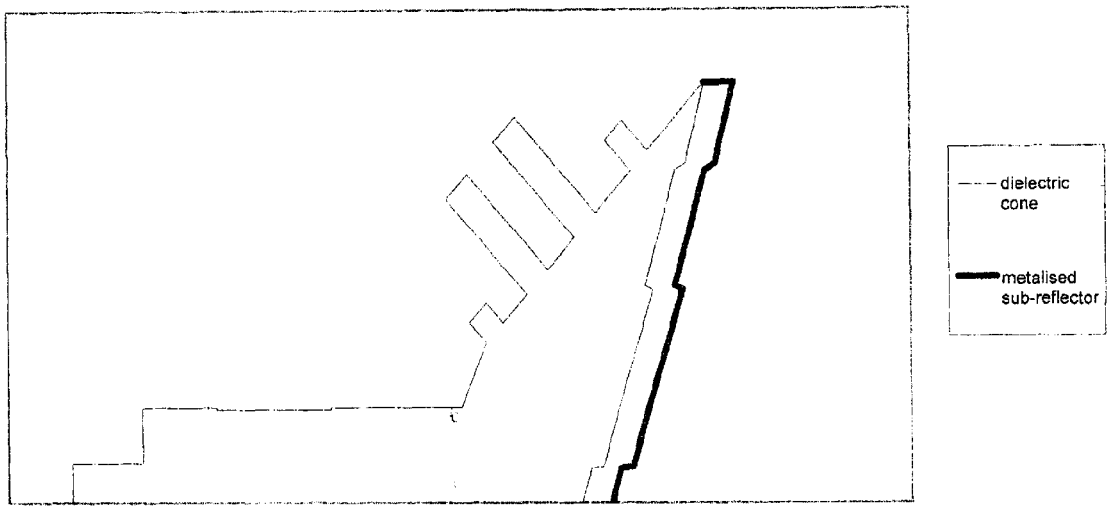

Figure 13b: Etheta and EPhi Amplitude Radiation Patterns
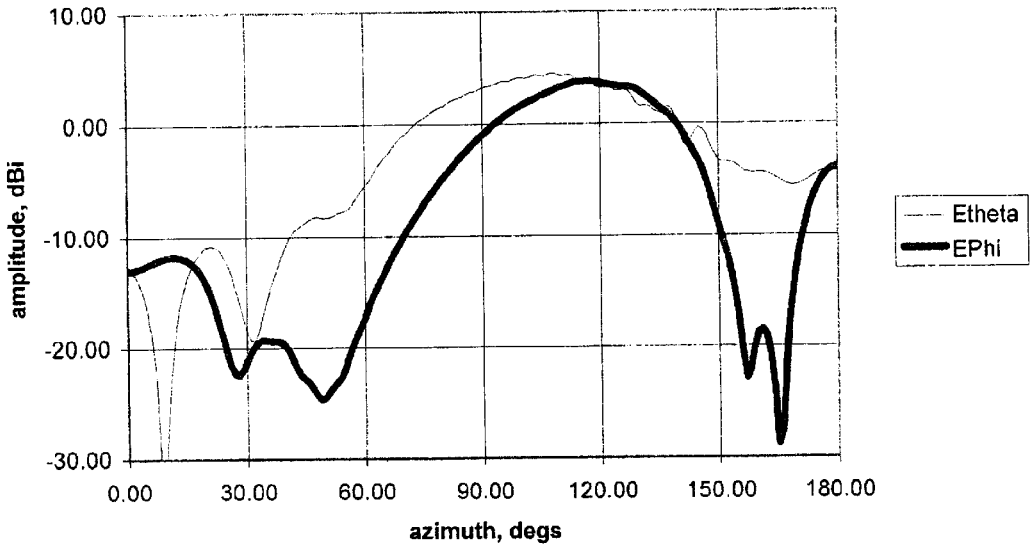
Figure 13c: Etheta and Ephi Phase Patterns
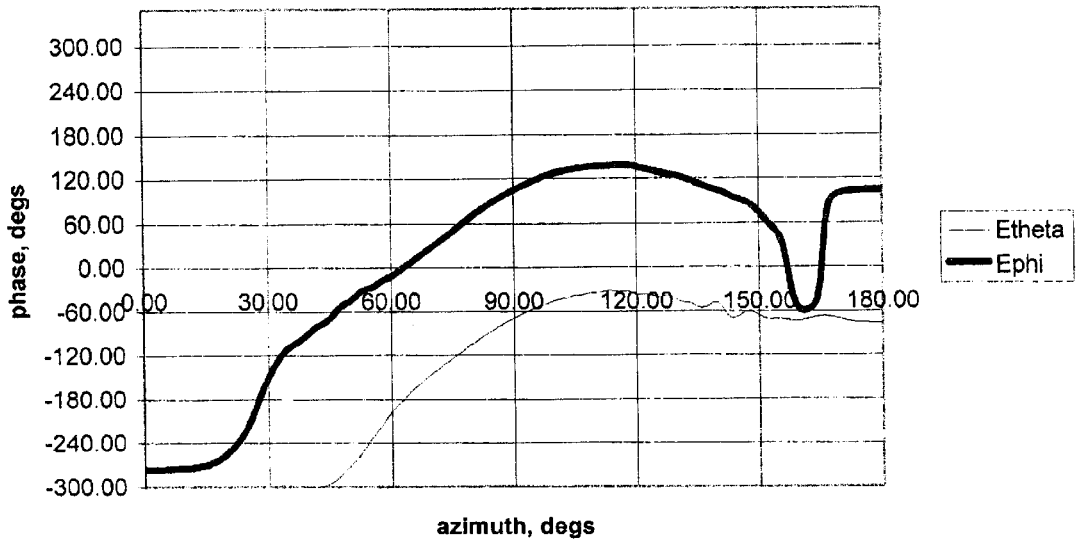

Figure 13d: 38GHz 1' Measured Radiation Patterns of Sixth Embodiment: E-plane vs ETSI and FCC specs
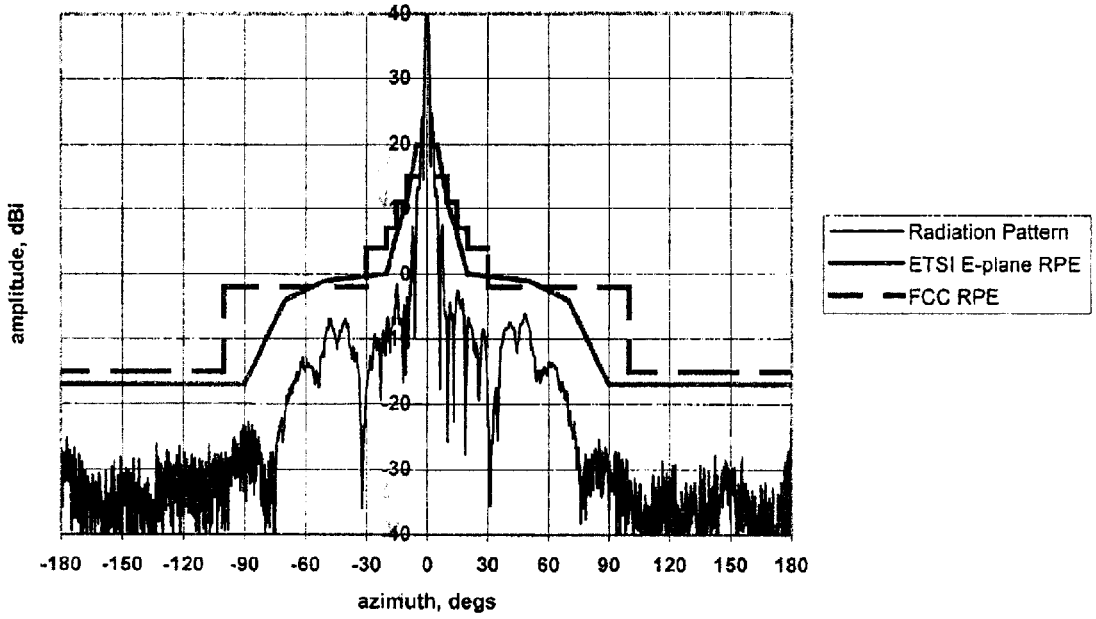
Figure 13e: 38GHz 1' Measured Radiation Patterns of Sixth Embodiment: H-plane vs ETSI and FCC specs
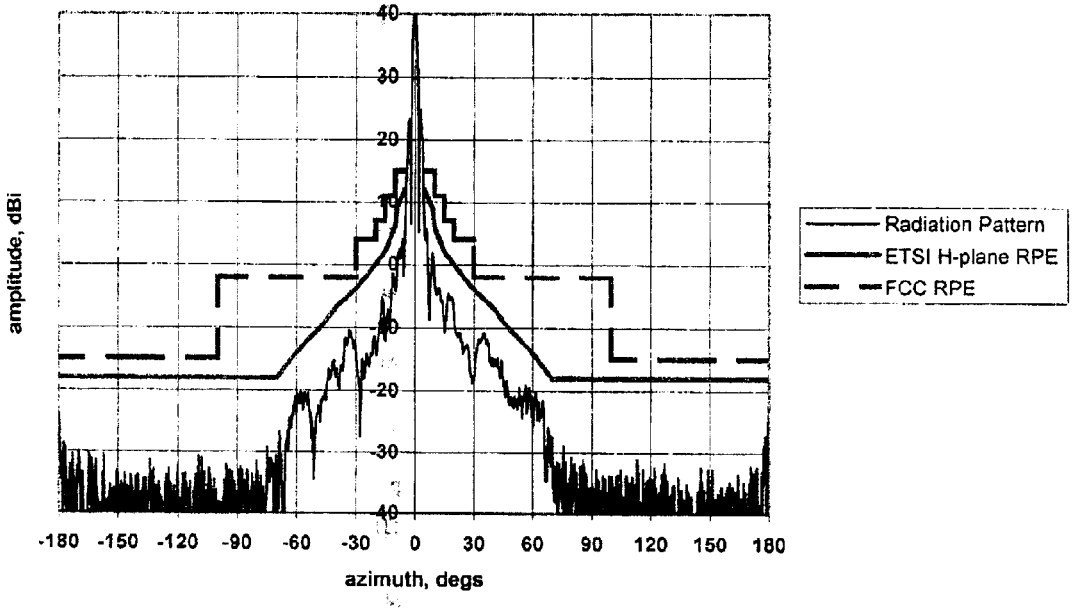

TUNED PERTURBATION CONE FEED FOR REFLECTOR ANTENNA

BACKGROUND OF INVENTION

1. Field of the Invention

This invention relates to microwave dual reflector antennas typically used in terrestrial point to point, and point to multipoint applications. More particularly, the invention provides a low cost self supported feed solution for use in frequency bands between 5 GHz and 60 GHz wherein stringent regulatory standard compliance and or specific system electrical characteristics are required. The invention is particularly suited to "deep dish" designs overcoming performance limitations of prior art devices and obviating the need for a conventional shroud assembly. It is also applicable to more conventional dish profiles.

2. Description of Related Art

Dual reflector antennas employing self-supported feed direct a signal incident on the main reflector onto a sub-reflector mounted adjacent to the focal region of the main reflector, which in turn directs the signal into a waveguide transmission line typically via a feed horn or aperture to the first stage of a receiver. When the dual reflector antenna is used to transmit a signal, the signals travel from the last stage of the transmitter system, via the waveguide, to the feed aperture, sub-reflector, and main reflector to free space.

Dual reflector antennas utilizing a sub-reflector supported and fed by a waveguide are relatively cost efficient. This configuration also facilitates the mounting of an "Outdoor Unit" comprising the initial stages of a transceiver system, directly onto the back of the main reflector and also eliminates the need for a separate feed support structure that would conventionally span the face of the main reflector, thereby introducing some loss in operating efficiency. The waveguide can have either a rectangular cross-section, whereby the antenna is single polarized, or can have a square or circular cross-section facilitating dual-polarization operation.

The electrical performance of an antenna used in terrestrial communications is characterized by its gain, radiation pattern, cross-polarization and return loss performance efficient gain, radiation pattern and cross-polarization characteristics are essential for efficient microwave link planning and coordination, whilst a good return loss is necessary for efficient radio operation.

These principal characteristics are determined by a feed system designed in conjunction with the main reflector profile. Conventional antenna designs used extensively in terrestrial point to point communications utilize a parabolic main reflector together with either a "J-hook" type waveguide feed system, or a self supported sub-reflector type feed system. In order to achieve "high performance" radiation pattern characteristics, these designs typically use an RF energy absorber lined cylindrical shroud around the outer edge of the main reflector antenna in order to improve the radiation pattern particularly in directions from approximately 50 to 180 degrees from the forward on axis direction. Shrouds however increase the overall weight, wind load, structural support and manufacturing costs of the antenna.

An alternative method to improve the radiation pattern in these angular regions is to use a "deep" dish reflector, i.e. the ratio of the reflector focal length (F) to reflector diameter (D) is made less than or equal to 0.25 (as opposed to an F/D of 0.35 typically found in more conventional dish designs).

Such designs can achieve "high performance" radiation pattern characteristics without the need for a separate shroud assembly when used with a carefully designed feed system which provides controlled dish illumination, particularly toward the edge of the dish. One such design which uses corrugations proximate to the outer radius of the sub-reflector to inhibit surface propagation and or field diffraction around the outer edge of the sub-reflector is described in U.S. Pat. No. 5,959,590 issued Sep. 28, 1999 to Sandford et al.

In dual-reflector feeds employing dielectric cone supported sub-reflectors, adequate feed radiation pattern characteristics may be designed for conventional (F/D>0.25) reflectors using simple unperturbed conic surfaces. Such a d presents a requirement for the feed to efficiently illumninate the main reflector over a total subtended angle of typically 130 degrees. FIG. 1*a* illustrates one such design FIGS. 1*b* and 1*c* show models of the typical resulting amplitude and phase feed radiation patterns of this configuration.

In order to provide the larger angular illumination for a "deep dish" reflector (subtended angle >180 degrees), such a simple design is limited by internal and multi-path reflections prevalent within the cone structure between the rear reflecting surface and the leading edge boundary resulting in poorly controlled amplitude and phase radiation patterns with deep nulls at some frequencies within a typical operating band. FIG. 2*a* illustrates one such design. FIGS. 2*b* and 2*c* show typical models of the resulting amplitude and phase feed radiation patterns for this configuration.

Multiple internal reflections can be reduced by the use of a regular array of corrugations positioned on the leading edge (cone surface closest to the main reflector). FIG. 3*a* illustrates one such design. FIGS. 3*b* and 3*c* show typical models of the resulting amplitude and phase feed radiation patterns of this configuration, as described in European Patent Application 0 A439 800 A1 by Kuhne filed December 1990. Such a configuration improves the impedance match between the cone medium and that of free space, thus presenting a less severe impedance boundary to the RF signal path. However such a configuration only partially resolves the internal reflections and can have a detrimental effect on both amplitude and phase radiation match between E and H planes.

Therefore it is the object of the invention to provide an apparatus that overcomes limitations in the prior art, and in so doing present ea solution that allows such a feed design to provide reflector antenna characteristics which meet the most stringent electrical specifications over the entire operating band used for a typical terrestrial communication microwave link.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

FIG. 1*a*, is a partial schematic side cross-section view of a prior art embodiment of a dielectric cone supported sub-reflector used, for example, in conventional dual reflector antennas using shallow dish reflectors.

FIG. 1*b* is a model of a typical amplitude feed radiation pattern for an antenna with the sub-reflector configuration of FIG. 1*a*.

FIG. 1*c* is a model of a typical phase feed radiation pattern for an antenna with the sub-reflector configuration of FIG. 1*a*.

FIG. 2*a* is a partial schematic side cross-section view of a prior art embodiment of a dielectric cone supported sub-reflector cone body used in conventional dual reflector antennas using deep dish main reflectors.

FIG. 2*b* is a model of a typical amplitude feed radiation pattern for an antenna with the sub-reflector configuration of FIG. 2*a*.

FIG. 2*c* is a model of a typical phase feed radiation pattern for an antenna with the sub-reflector configuration of FIG. 2*a*.

FIG. 3*a* is a partial schematic side cross-section view of a prior art embodiment of a dielectric cone supported sub-reflector as disclosed for example by the Kuhne reference, above.

FIG. 3*b* is a model of a typical amplitude feed radiation pattern for an antenna with the sub-reflector configuration of FIG. 3*a*.

FIG. 3*c* is a model of a typical phase feed radiation pattern for an antenna with the sub-reflector configuration of FIG. 3*a*.

FIG. 6*a* is a chart off measured 22 GHz E-plane co-polar radiation patterns achieved using the sub-reflector of FIGS. 5*a–e* within a 1" diameter shaped deep dish main-reflector, compared to ETSI E-plane and FCC regulatory radiation pattern specifications.

FIG. 6*b* is a chart of measured 22 GHz H-plane co-polar radiation patterns achieved using the sub-reflector of FIGS. 5*a–e* within a 1diameter shaped deep dish main-reflector, compared to ETSI E-plane and FCC regulation pattern specifications.

FIG. 7 is a chart of measured and modeled return loss for the embodiment shown in FIGS. 5*a–e*.

FIG. 9*a* is a chart of measured 22 GHz E-plane co-polar radiation patterns achieved using the sub-reflector of FIGS. 5*a–e* within a 1" diameter shaped deep dish main-reflector, compared to ETSI E-plane and FCC regulation pattern specifications.

FIG. 9*b* is a chart of measured 22 GHz H-plane co-polar radiation patterns achieved using the sub-reflector of FIGS. 5*a–e* within a 1" diameter shaped deep dish main-reflector, compared to ETSI E-plane and FCC regulation pattern specifications.

FIG. 10*a* is a partial schematic side cross-section view of a third embodiment of a dielectric cone supported sub-reflector cone body according to the invention.

FIG. 10*b* is a model of a typical amplitude feed radiation pattern for the antenna with the sub-reflector configuration of FIG. 10*a*.

FIG. 10*c* is a model of a typical phase feed radiation pattern for the antenna with the sub-reflector configuration of FIG. 10*a*.

FIG. 11*a* is a partial schematic side cross-section view of a fourth embodiment of a dielectric cone supported sub-reflector cone body according to the invention.

FIG. 11*b* is a model of a typical amplitude feed radiation pattern for the antenna with the sub-reflector configuration of FIG. 11*a*.

FIG. 11*c* is a model of a typical representative phase feed radiation pattern for the antenna with the subreflector configuration of FIG. 11*a*.

FIG. 12*a* is a partial schematic side cross-section view of a fifth embodiment of a dielectric cone supported subreflector cone body having radial chokes (corrugations), according to the invention.

FIG. 12*b* is a model of a typical amplitude feed radiation pattern for an antenna with the sub-reflector configuration of FIG. 12*a*.

FIG. 12*c* is a model of a typical phase feed radiation pattern for the antenna with the sub-reflector configuration of FIG. 12*a*.

FIG. 13*a* is a partial schematic side cross-section view of a sixth embodiment of a dielectric cone supported sub-reflector configured to provide un-equal E and H-plane primary patterns, according to the invention.

FIG. 13*b* is a model of a typical amplitude feed radiation pattern for the antenna of FIG. 13*a*.

FIG. 13*c* is a model of a typical phase feed radiation pattern for the antenna of FIG. 13*a*.

FIG. 13*d* is a chart of measured 38 GHz E-plane co-polar radiation patterns achieved using the sub-reflector of FIG. 13*a* within a 1" diameter shaped main-reflector, compared to ETSI and FCC radiation pattern specifications.

FIG. 13*e* is a chart of measured 38 GHz H-plane co-polar radiation patterns achieved using the sub-reflector of FIG. 13*a* within a 1" diameter shaped main-reflector, compared to ETSI and FCC radiation pattern specifications.

DETAILED DESCRIPTION

The self-supported feed system described herein integrates the waveguide transmission line, aperture and sub-reflector into a single assembly comprising a length of waveguide, the aperture of which is terminated with a corrugated dielectric cone sub reflector assembly, the front and back surfaces of which are geometrically shaped and corrugated to provide a desired amplitude and phase radiation pattern suitable for efficient illumination of the main reflector profile.

Figure 4A:
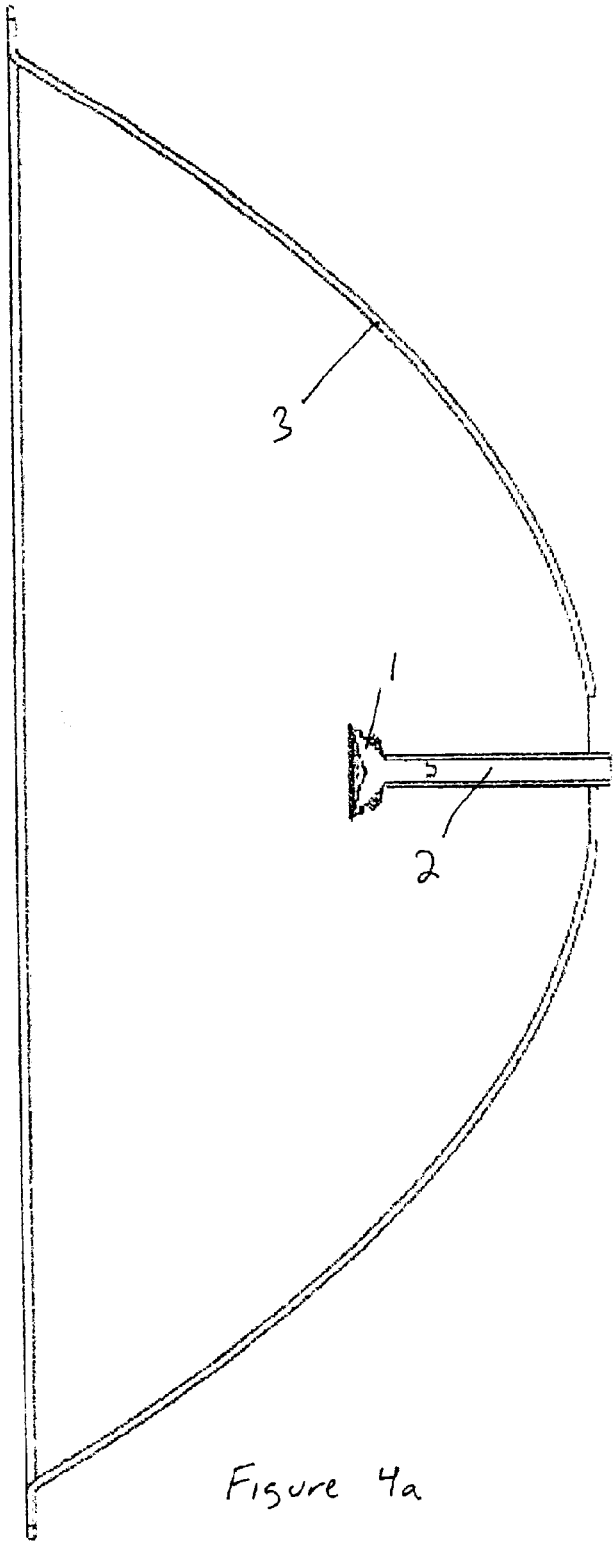
FIG. 4*a* is a cut-away side view of a deep dish dual reflector antenna with a self supported feed assembly with a tuned perturbation crone feed sub-reflector according to one embodiment of the invention.
Figure 4B:
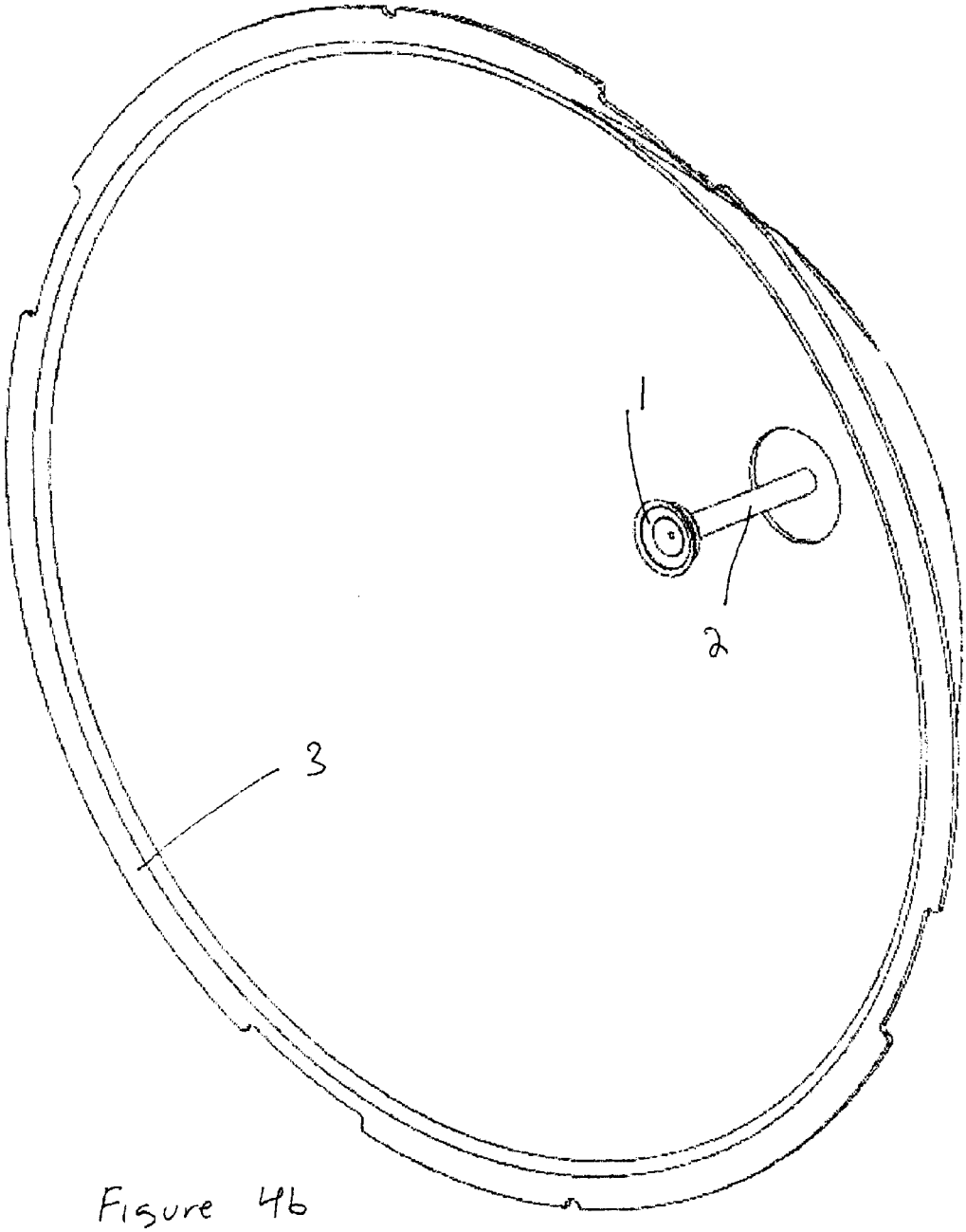
FIG. 4*b* is an angled front isometric view of the antenna shown in FIG. 4*a*.
Figure 5A:
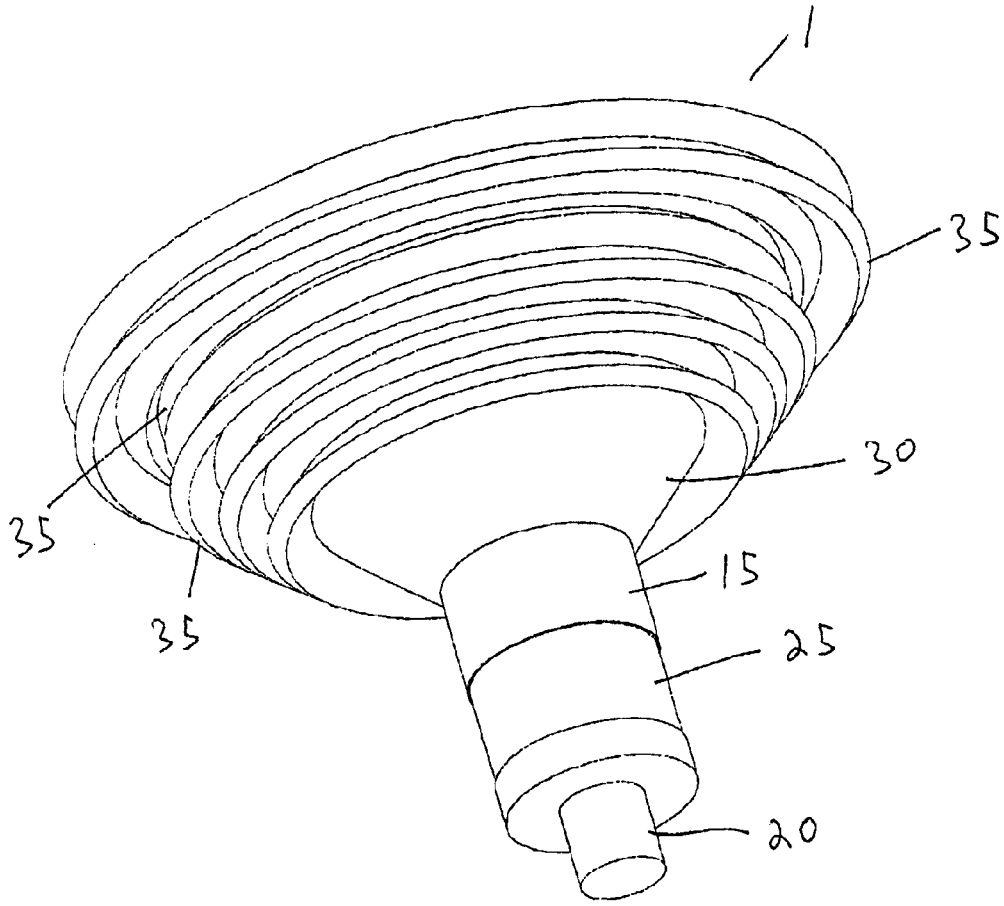
FIG. 5*a* is an angled external lower side isometric view of a dielectric cone supported sub-reflector according to a first embodiment of the invention.
Figure 5B:
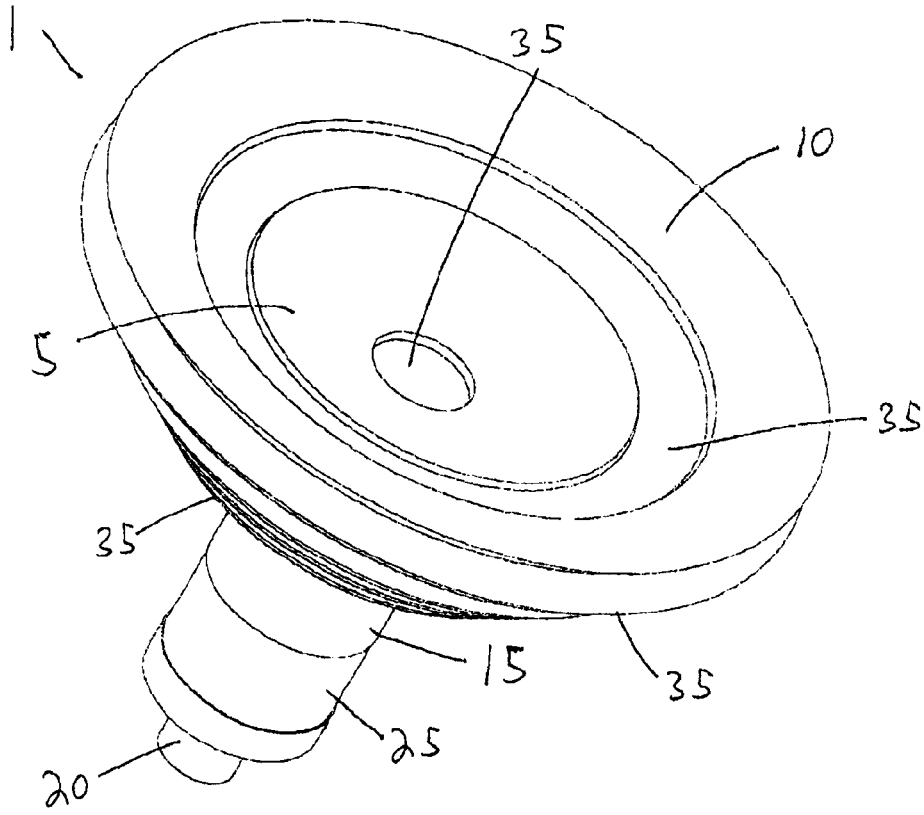
FIG. 5*b* is an angle external upper side isometric view of the dielectric cone supported sub-reflector shown in FIG. 5*a*.
Figure 5C:
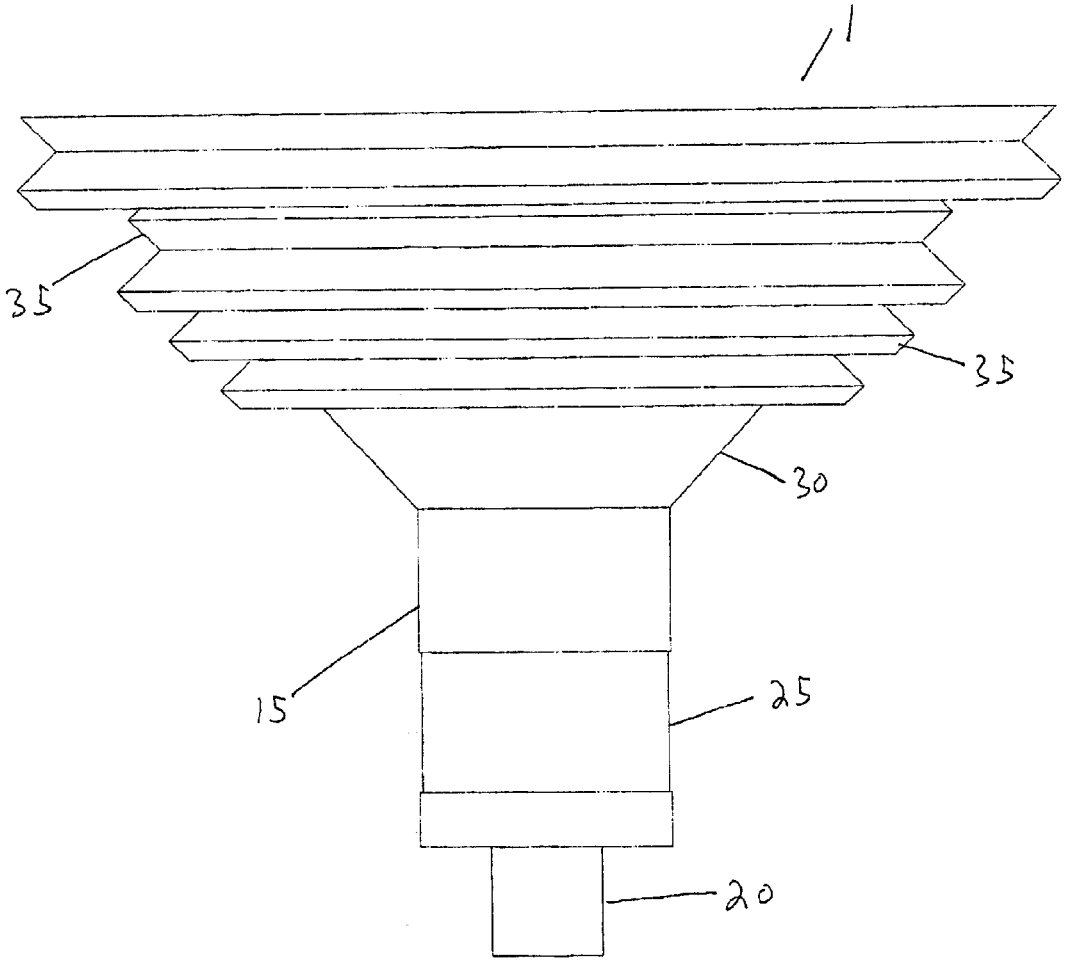
FIG. 5*c* is an external side view of the dielectric cone supported subreflector shown in FIG. 5*a*.
Figure 5E:
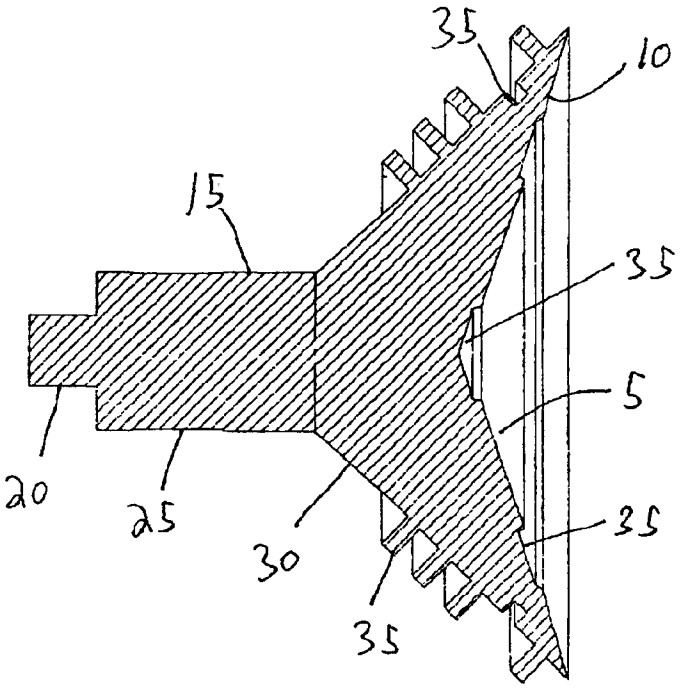
FIG. 5*e* is a cut-away side view along the section line A—A of FIG. 5*d*.
Figure 5D:
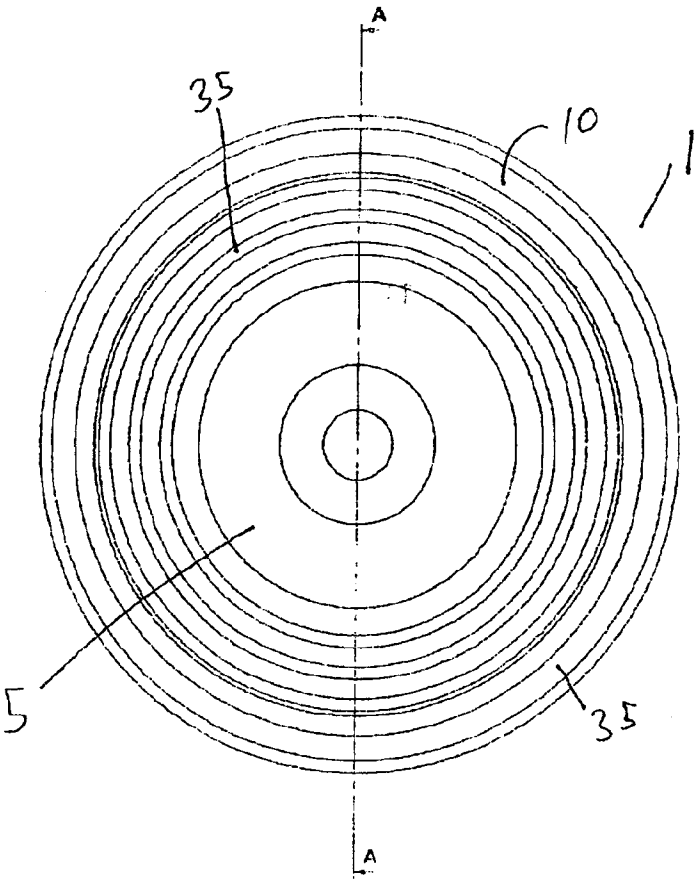
FIG. 5*d* is a top view of the dielectric cone supported sub-reflector shown in FIG. 5*a*.
Figure 8A:
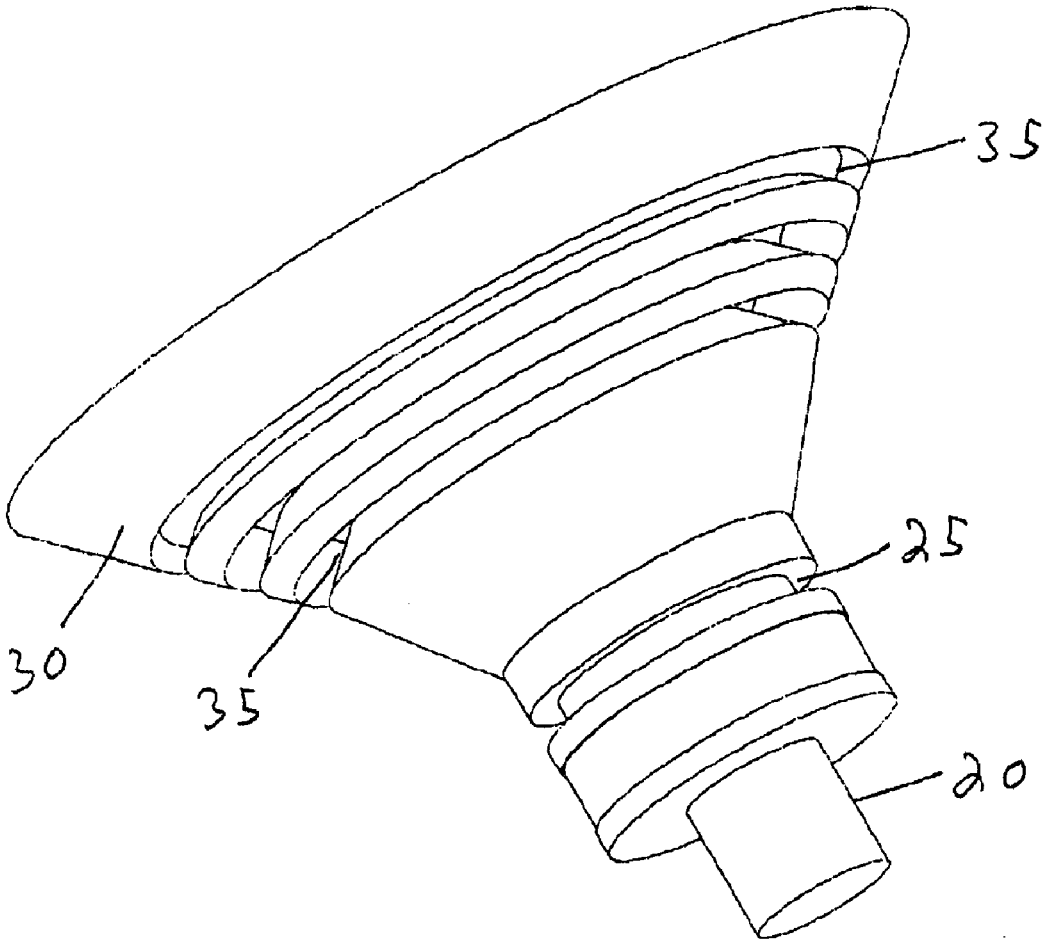
FIG. 8*a* is an angled external lower side isometric view of a dielectric cone supported sub-reflector according to a second embodiment of the invention.
Figure 8B:
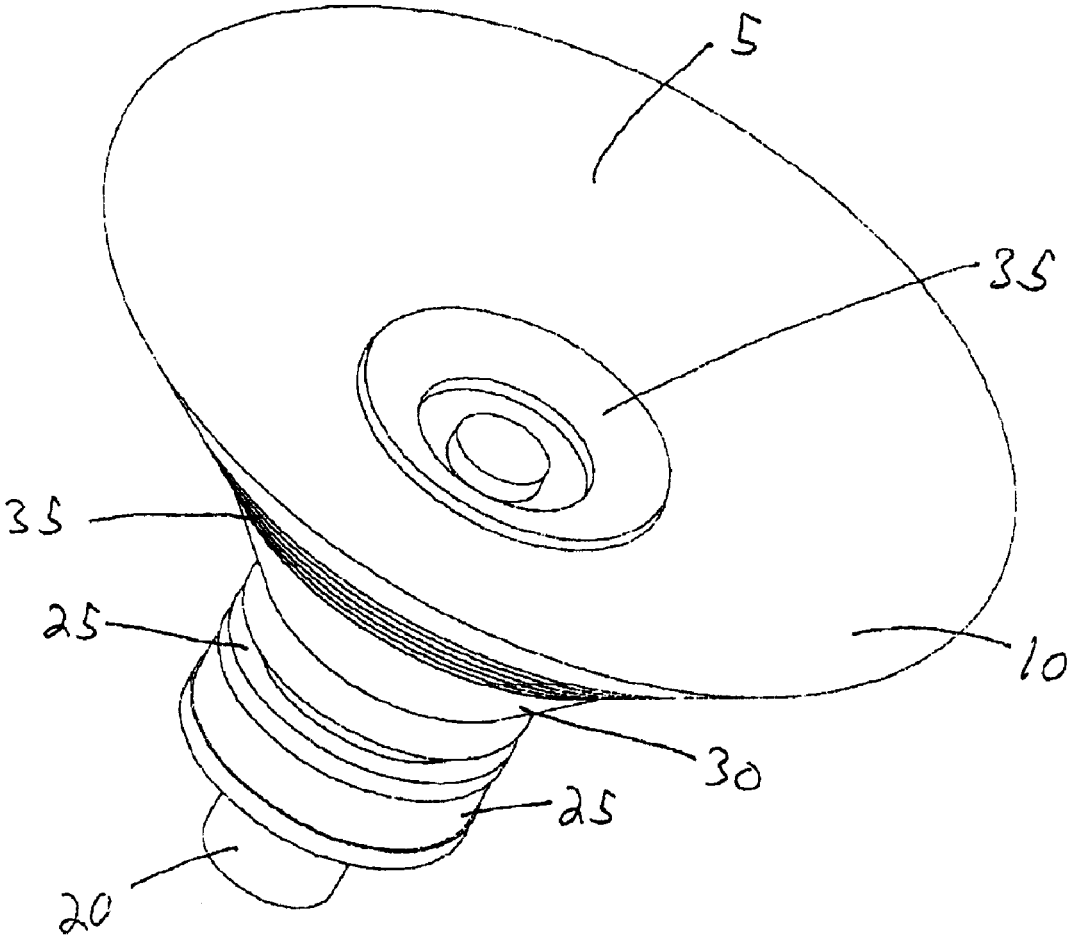
FIG. 8*b* is an angled external upper side isometric view of the dielectric cone supported sub-reflector shown in FIG. 8*a*.
Figure 8C:
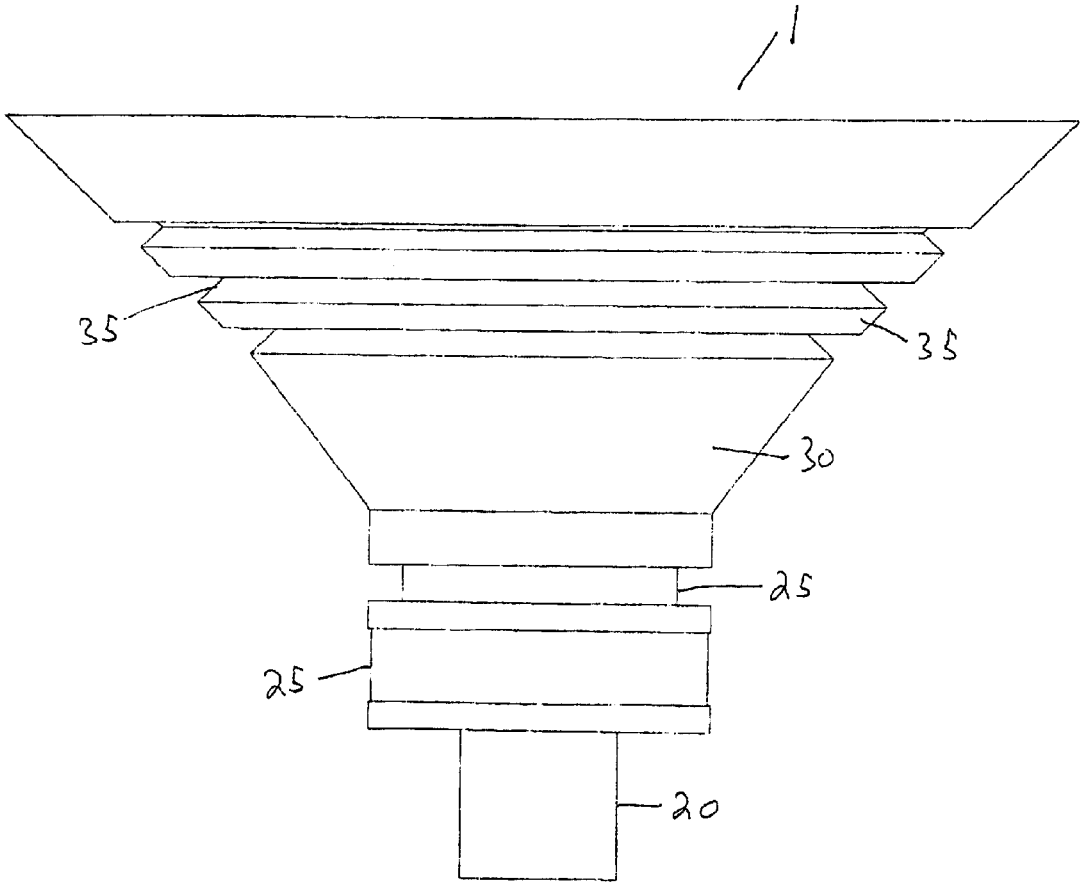
FIG. 8*c* is an external side view of the dielectric cone supported subreflector shown in FIG. 8*a*.
Figure 4A:
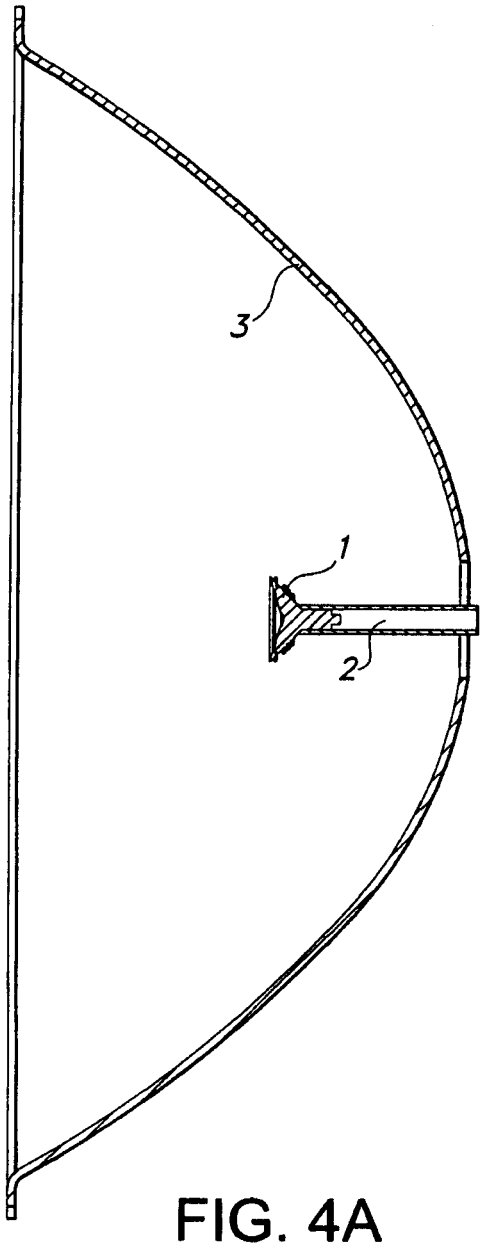
Figure 4B:
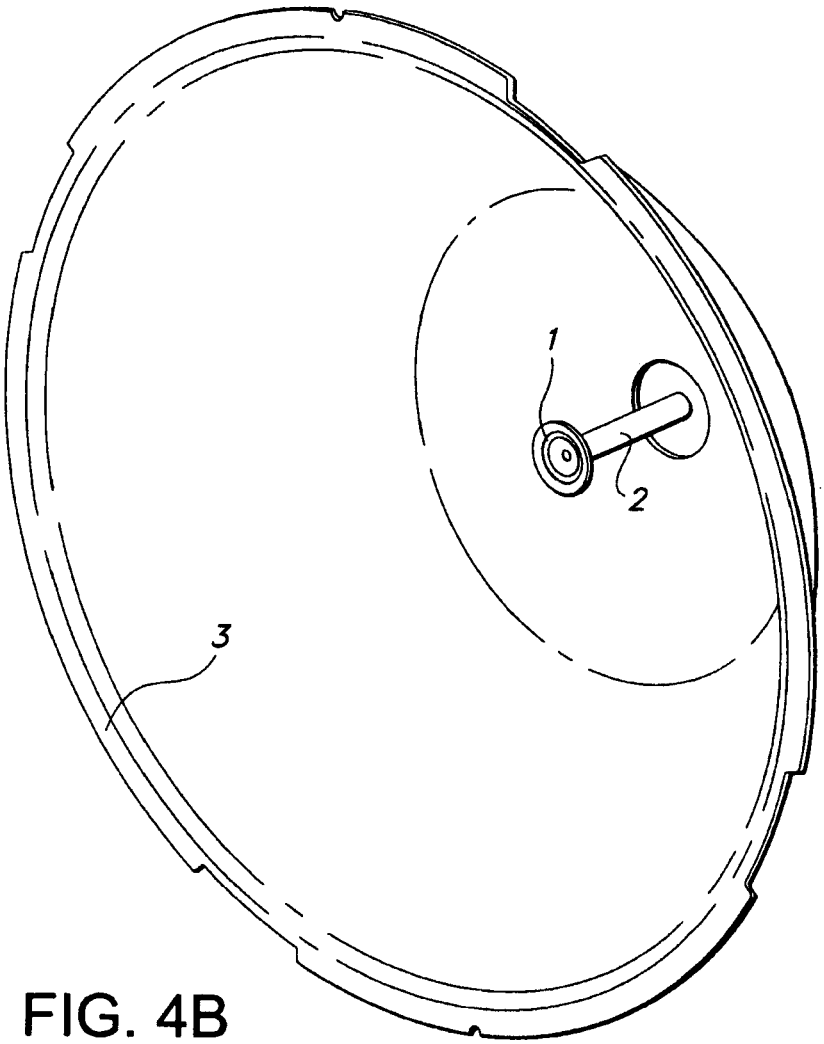
Figure 5A:
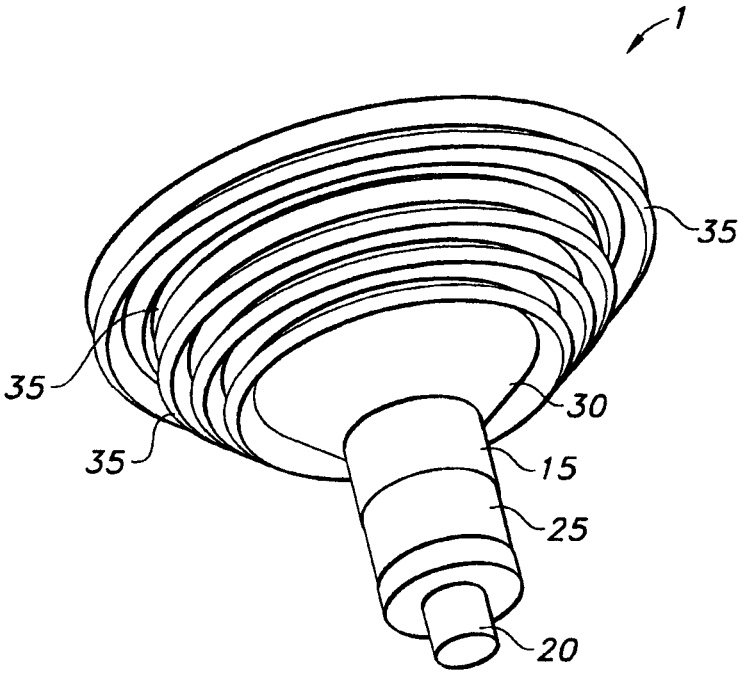
Figure 5B:
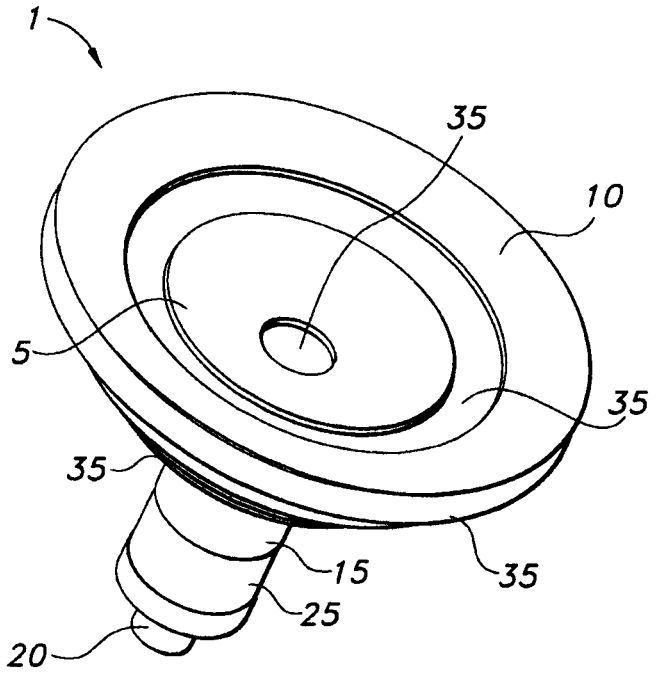
Figure 5C:
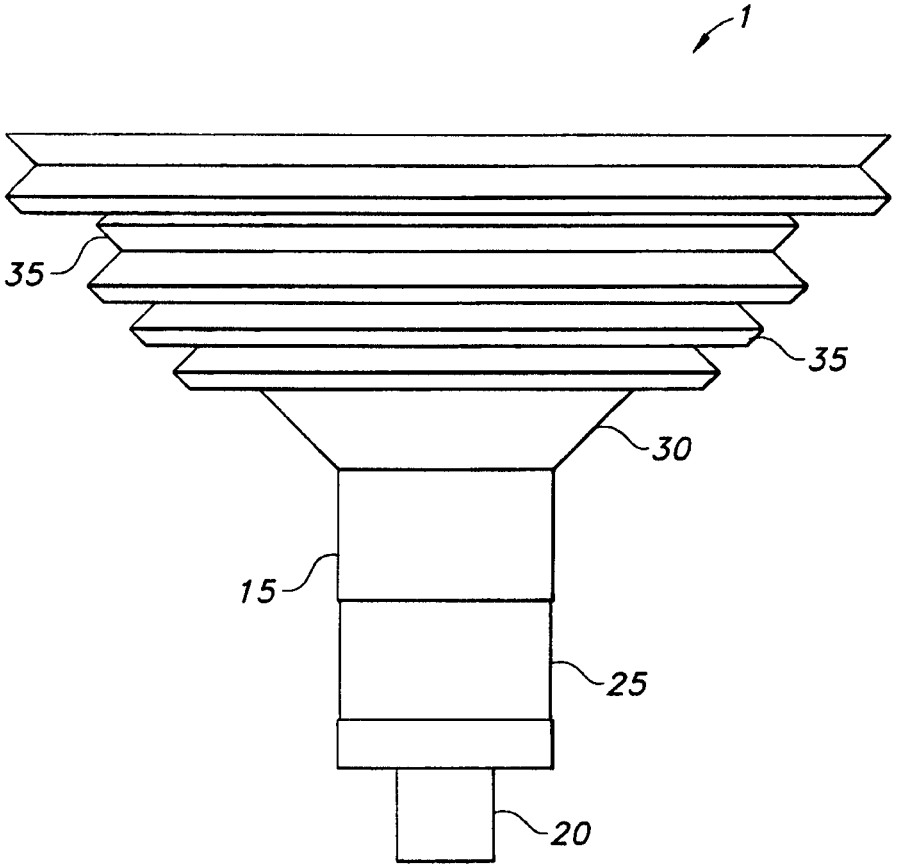
Figure 5E:
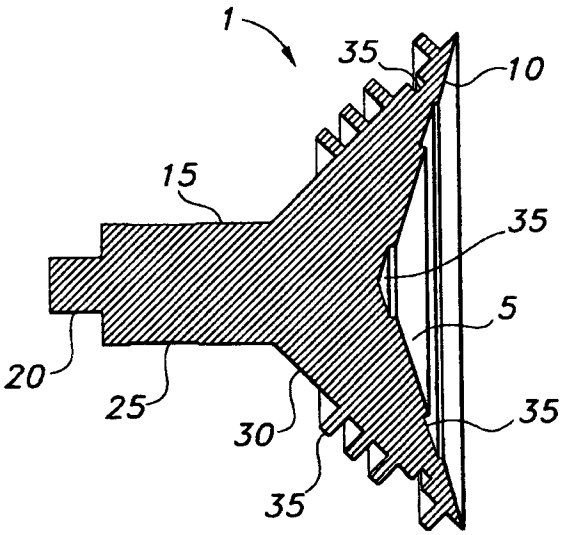
Figure 5D:
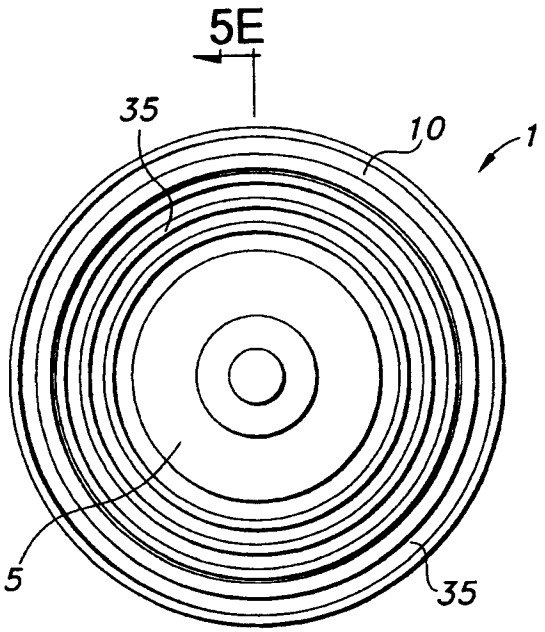
Figure 8A:
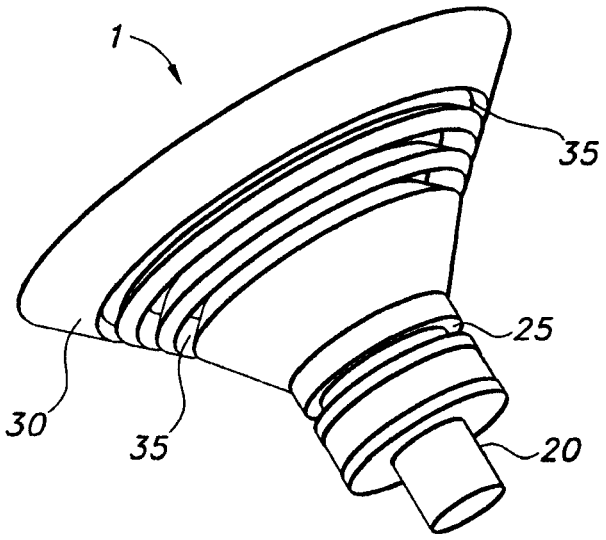
Figure 8B:
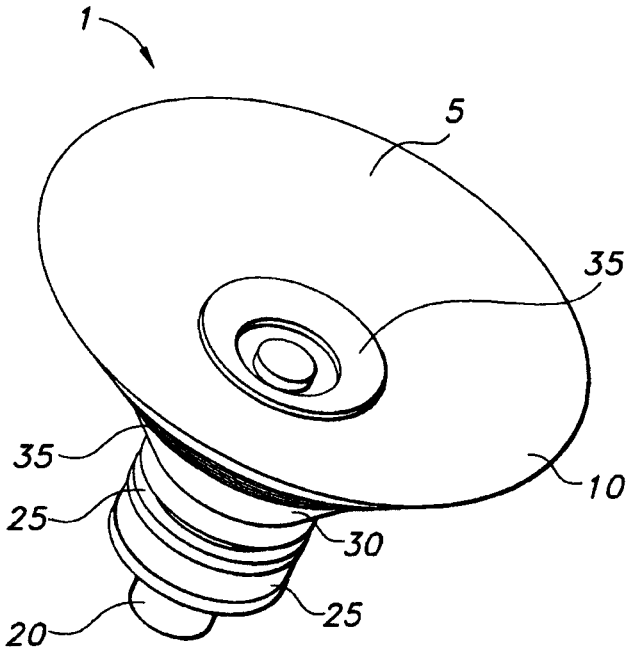
Figure 8C:
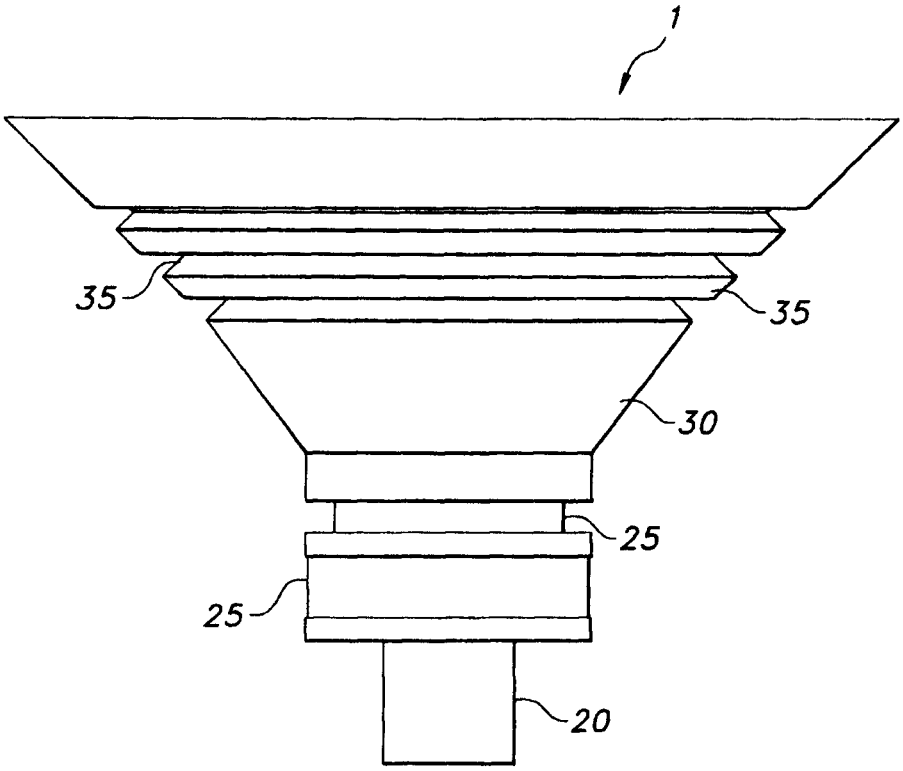
Figure 8E:
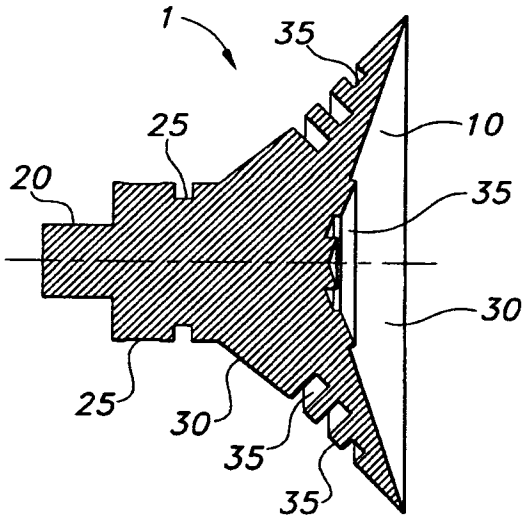
FIG. 8*e* is a cut-away side view along the section line A—A of FIG. 8*d*.
Figure 8D:
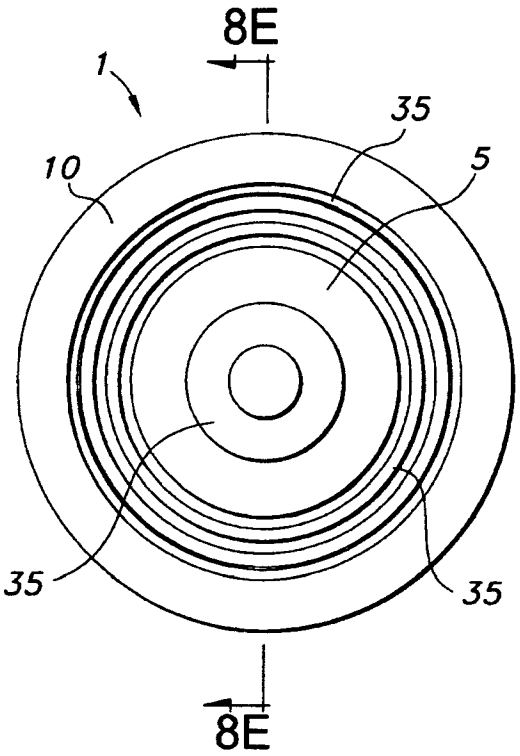
FIG. 8*d* is a top view of the dielectric cone supported sub-reflector shown in FIG. 8*a*.

A typical dual reflector antenna according to the invention is shown in FIGS. 4*a* and 4*b*. The sub-reflector assembly 1 is mounted on and supported by a waveguide 2 to position the sub-reflector assembly 1 proximate a focal point of the dish reflector 3, here shown as a dish reflector 3 having a "deep dish" configuration.

Details of the sub-reflector 1 assembly according to the invention will now be described in detail. A first embodiment of a sub-reflector 1 according to the invention is shown in FIGS. 5*a–e*. Representative and measured performance of the first embodiment is shown in FIGS. 6*a*–7. Further embodiments and their respective representative and or measured performance is shown in FIGS. 8*a*–13*e*. The sub-reflector assembly 1 may be formed, for example, by injection molding and or machining a block of dielectric plastic. A sub-reflector surface 5 of the sub-reflector assembly 1 may be formed by applying a metallic deposition, film, sheet or other RF reflective coating 10 to the top surface of the dielectric block. A waveguide junction portion 15 of the sub-reflector assembly 1 is adapted to match a desired circular waveguide 2 internal diameter so that the sub-reflector assembly 1 may be fitted into arid retained by the waveguide 2 that supports the sub-reflector assembly 1 within the dish reflector 3 of the reflector antenna proximate a focal point of the dish reflectors 3.

One or more step(s) 20 at the end of the waveguide junction portion 10 and or one or more groove(s) 25 may be used for impedance matching purposes between the waveguide 2 and the dielectric material of the subreflector assembly 1.

The sub-reflector surface 5 and a leading cone surface 30 (facing the dish reflector 3) of the sub-reflector assembly 1 may have a plurality of concentric non-periodic perturbation (s) 35 in the form of corrugations, ridges and protrusions of varied heights, depths and or widths. Internal, external and combinations of internal and external perturbations may be applied. Also, a leading angle selected for pattern and VSWR matching between the waveguide junction portion 15 and a first perturbation, along the leading cone surface 30, may then change as the leading cone surface 5 continues to a periphery of the subreflector assembly 1, for example as shown on FIG. 13*a*. Where the prior art may have utilized a single perturbation for VSWR matching purposes, the present invention utilizes multiple perturbations to control internal reflections and thereby form a desired radiation pattern. Calculated using a full wave solution with the assistance of commercially available full wave RF radiation pattern calculation software rather than ray tracing, the location and specific dimensions of the perturbations and angle changes may be calculated and then further iteratively adjusted to minimize multi-path reflections within the dielectric material, control amplitude and phase distribution from the feed and improve the impedance match (VSWR) between the feed and free space.

Further, as shown for example by FIGS. 13*a–e*, contrary to common practice requiring manipulation of the waveguide entry dimensions, where electrical requirements are non-equivalent between the vertical and horizontal (E and H-plane, or Etheta and Ephi) polarizations, for example for the 38 GHz band (ETSI EN 300833 Class 5 FIG. 3C), the ridges height and width separately affect the different polarizations, at different frequency bands, even though the perturbation(s) 35 are concentric.

Because the perturbation(s) 35 are concentric, the sub-reflector assembly 1 need not be keyed to a specific orientation with the waveguide or reflector antenna. Also, machining of perturbation(s) 35 that would be difficult to form by injection molding, alone, is simplified if a concentric design is selected.

Adapting the perturbation(s) 35 to a desired configuration provides efficiencies that previously were obtained in part by correcting the profile of the dish reflector 3. When these adaptations are made via the perturbation(s) 35, the invention provides the advantage of higher performance over a wide frequency range, for example 10–60 GHz, with the same reflector dish profile.

The combination of A "deep" phase corrected reflector with a sub-reflector assembly 1 according to the invention results in a reflector antenna operable over a wide frequency range-with electrical characteristics previously available only with shallow profile reflector dishes with RF absorbing shrouds.

From the foregoing, it will be apparent that the present invention brings to the art a sub-reflector assembly 1 for a reflector antenna with improved electrical performance and significant manufacturing cost efficiencies. The subreflector assembly 1 according to the invention is strong, lightweight and may be repeatedly cost efficiently manufactured with a very high level of precision.

Table of Parts

| | |
|---|---|
| 1 | sub-reflector assembly |
| 2 | waveguide |
| 3 | dish reflector |
| 5 | sub-reflector surface |
| 10 | RF reflective coating |
| 15 | waveguide junction portion |
| 20 | step |
| 25 | groove |
| 30 | leading cone surface |
| 35 | perturbation |

Where in the foregoing description reference has been made to ratios, integers, components or modules having known equivalents then such equivalents are herein incorporated as if individually set forth.

Each of the patents and published patent applications identified in this specification are herein incorporated by reference in their entirety to the same extent as if each individual patent was fully set forth herein for all each discloses or if specifically and individually indicated to be incorporated by reference.

while the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

What is claimed is:

1. A sub-reflector assembly for a reflector antenna with a waveguide supported sub-reflector, comprising:

a dielectric block;

the dielectric block having a first diameter waveguide junction portion adapted for coupling to an end of the waveguide;

a sub-reflector surface coated with an RF reflective material having a periphery at a second diameter larger than the first diameter; and a leading cone surface extending from the waveguide junction portion to the second diameter at an angle;

the sub-reflector surface and the leading cone surface having a plurality of non-periodic perturbations concentric about a longitudinal axis of the dielectric block.

2. The assembly of claim 1, wherein the perturbations include ridges and or grooves of varied width and height.

3. The assembly of claim 1, wherein the waveguide junction portion coupling is via insertion into an end of the waveguide.

4. The assembly of claim 1, wherein the waveguide junction portion has at least one groove and at least one step.

5. The assembly of claim 1, further including at least one radial corrugation in the periphery.

6. The assembly of claim 1, wherein the angle is a first angle between the waveguide junction portion and a first location along the leading cone surface and a second angle from the first location to the periphery.

7. The assembly of claim 1, wherein the perturbations are adapted to create a desired phase correction to a radiation pattern of the sub-reflector.

8. The assembly of claim 1, wherein the perturbations are adapted to create a desired amplitude correction to a radiation pattern of the sub-reflector.

9. The assembly of claim 1, wherein the perturbations are adapted to create a desired radiation pattern that is different between a vertical and a horizontal polarized portion of the radiation pattern.

10. The assembly of claim 1, wherein the perturbations are adapted to enable a desired radiation pattern over a range of frequencies, when the sub-reflector is mated with a single deep dish reflector configuration.

11. The assembly of claim 1, wherein the range of frequencies is a desired frequency band within 10 to 60 Gigahertz.

12. A method for forming a sub-reflector for a deep dish reflector antenna, comprising the steps of:

injection molding a dielectric block;

machining the dielectric block; and coating a sub-reflector surface of the dielectric block with an RF reflective material;

the dielectric block having a plurality of non-periodic perturbations, the perturbations selected to create a desired RF pattern distribution.

13. The method of claim 12, wherein the perturbations have varied heights, depths and widths.

14. The method of claim 12, wherein the plurality of non-periodic perturbations are located on the sub-reflector surface and a leading cone surface extending between the sub-reflector surface and a waveguide junction portion.

15. The method of claim 12, wherein the plurality of non periodic perturbations are calculated using a full wave solution.

16. The method of claim 15, wherein the calculation is performed using an RF wave modeling software program.

17. A sub-reflector assembly for a reflector antenna, comprising:

a block of dielectric material with a waveguide junction portion adapted for insertion into a waveguide mounted proximate the vertex of the deep dish reflector;

the dielectric block extending from the waveguide junction portion, over a leading cone surface, to a periphery of a sub-reflector surface;

the sub-reflector surface coated with an RF reflective material;

the leading cone surface and the sub-reflector surface having a plurality of concentric, non-periodic perturbations.

18. The assembly of claim 17, wherein the perturbations are a plurality of grooves and ridges having a range of different heights, widths and or depths.

19. The assembly of claim 17, wherein the perturbations form a radiation pattern adapted for a profiled deep dish reflector.

20. The assembly of claim 19, wherein the radiation pattern is different for a vertical and a horizontal polarized component of the radiation pattern.

21. The assembly of claim 19, wherein the radiation pattern is adapted for operation over a desired range of frequencies.

22. The assembly of claim 21, wherein the desired range of frequencies is a frequency band within 10 to 60 Gigaherts.

* * * * *

UNITED STATES PATENT AND TRADEMARK OFFICE

CERTIFICATE OF CORRECTION

PATENT NO. : 6,919,855 B2
APPLICATION NO. : 10/605262
DATED : July 19, 2005
INVENTOR(S) : Hills It is certified that error appears in the above-identified patent and that said Letters Patent is hereby corrected as shown below:

The title page, showing an illustrative figure, should be deleted and substitute therefor the attached title page.

Delete drawing sheets 1-25 and substitute therefor the drawing sheets, consisting of figures 1-13e as shown on the attached pages.

Signed and Sealed this

Seventh Day of December, 2010

David J. Kappos

David J. Kappos
*Director of the United States Patent and Trademark Office*

(12) United States Patent
Hills

(10) Patent No.: US 6,919,855 B2
(45) Date of Patent: Jul. 19, 2005

(54) TUNED PERTURBATION CONE FEED FOR REFLECTOR ANTENNA

(75) Inventor: Chris Hills, Fife (GB)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 10/605,262

(22) Filed: Sep. 18, 2003

(65) Prior Publication Data

US 2005/0062663 A1 Mar. 24, 2005

(51) Int. Cl.[7] ..... H01Q 19/19; H01Q 19/12
(52) U.S. Cl. ..... 343/781 CA; 343/840
(58) Field of Search ..... 343/781 CA, 784, 343/785, 792.5, 840, 872

(56) References Cited

U.S. PATENT DOCUMENTS 4,963,878 A 10/1990 Kildal ..... 343/781 P
5,959,590 A 9/1999 Sanford et al. ..... 343/781 P
5,973,652 A 10/1999 Sanford et al. ..... 343/781 P
6,020,859 A * 2/2000 Kildal ..... 343/781 CA
6,137,449 A * 10/2000 Kildal ..... 343/781 P
6,429,826 B2 8/2002 Karlsson et al. ..... 343/781 P
6,456,253 B1 * 9/2002 Rummeli et al. ..... 343/839
6,731,249 B1 * 5/2004 Gau et al. ..... 343/840

* cited by examiner

*Primary Examiner*—Wilson Lee
*Assistant Examiner*—Minh Dieu A
(74) *Attorney, Agent, or Firm*—Babcock IP, LLC

(57) ABSTRACT

A sub-reflector for a dish reflector antenna with a waveguide supported sub-reflector. The sub-reflector formed from a dielectric block, concentric about a longitudinal axis. The dielectric block having a first diameter waveguide junction portion adapted for coupling to an end of the waveguide and a sub-reflector surface coated with an RF reflective material having a periphery with a second diameter larger than the first diameter. A leading cone surface extends from the waveguide junction portion to the second diameter at an angle. The sub-reflector surface and the leading cone surface having a plurality of non-periodic perturbations concentric about the longitudinal axis.

22 Claims, 25 Drawing Sheets

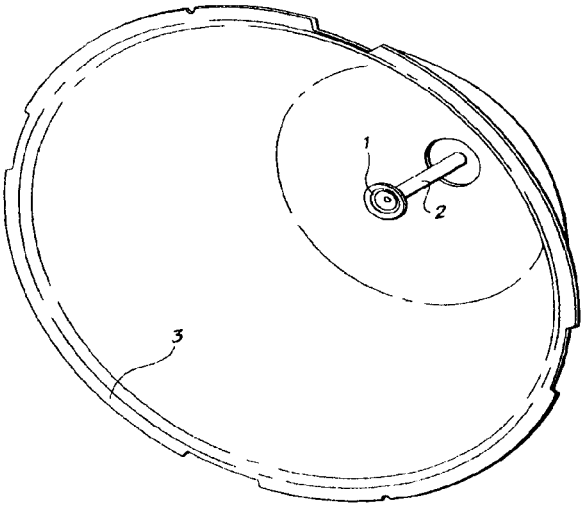

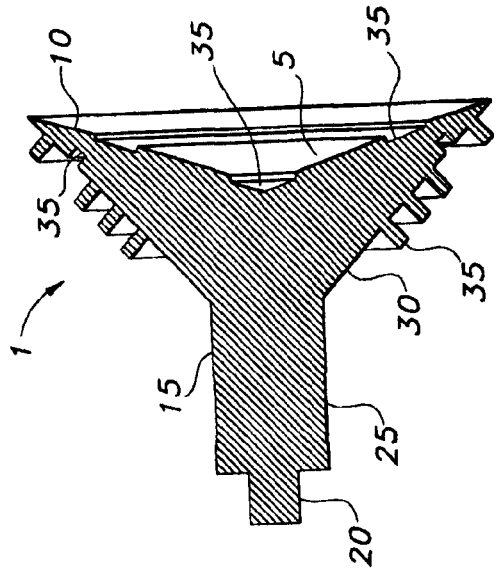

Fig. 1a Prior Art Cone Design
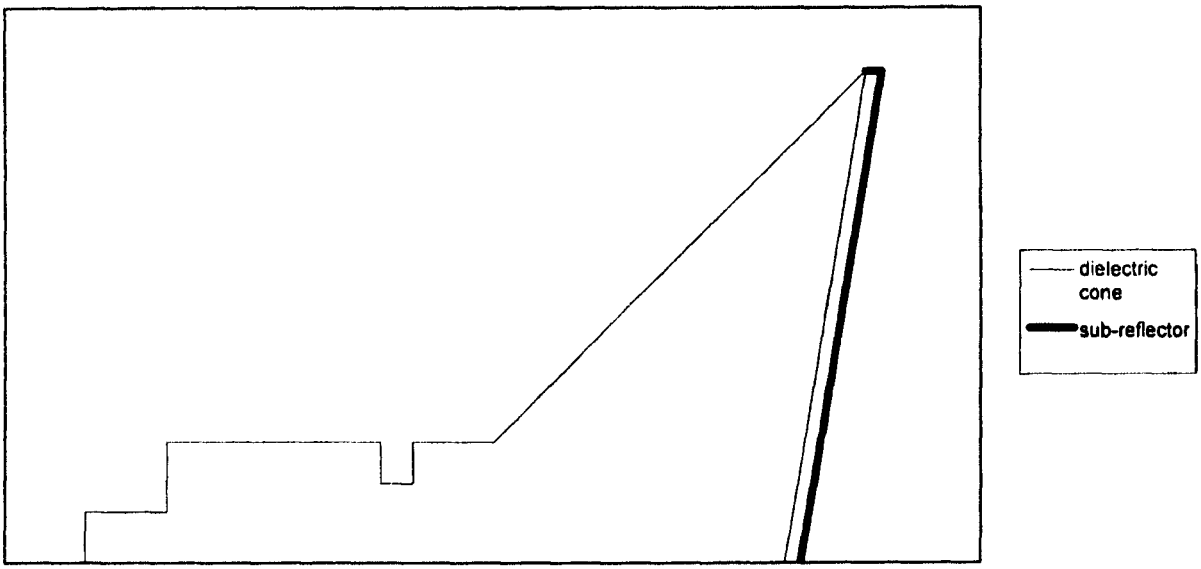
Fig. 1b: Etheta and EPhi Amplitude Radiation Patterns from Prior Art Cone Feed (F/D=0.37 typ)
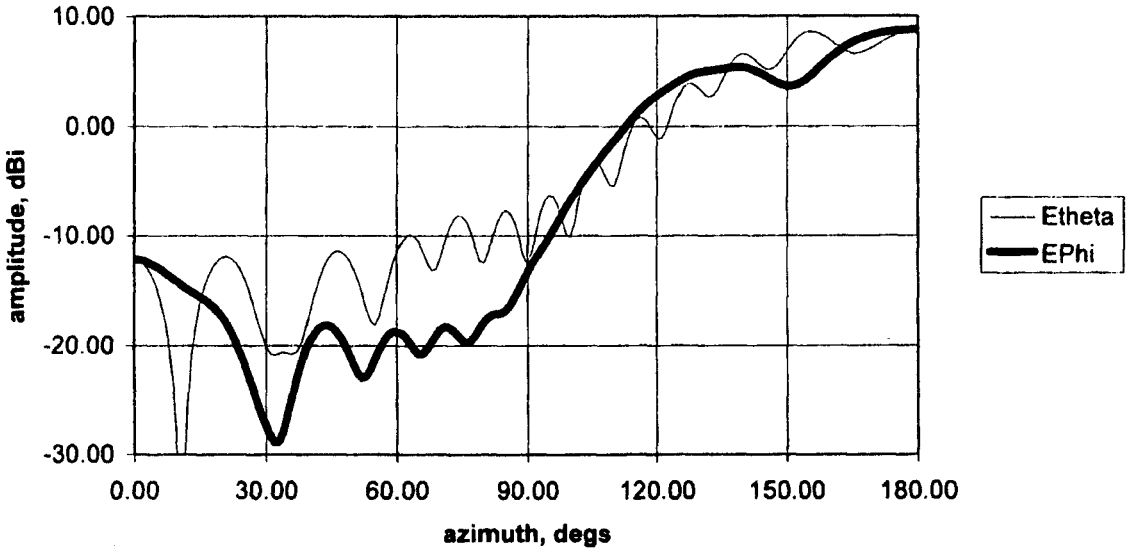

Fig. 1c: Etheta and Ephi Phase Patterns from Prior Art Cone Feed (F/D=0.37 typ)
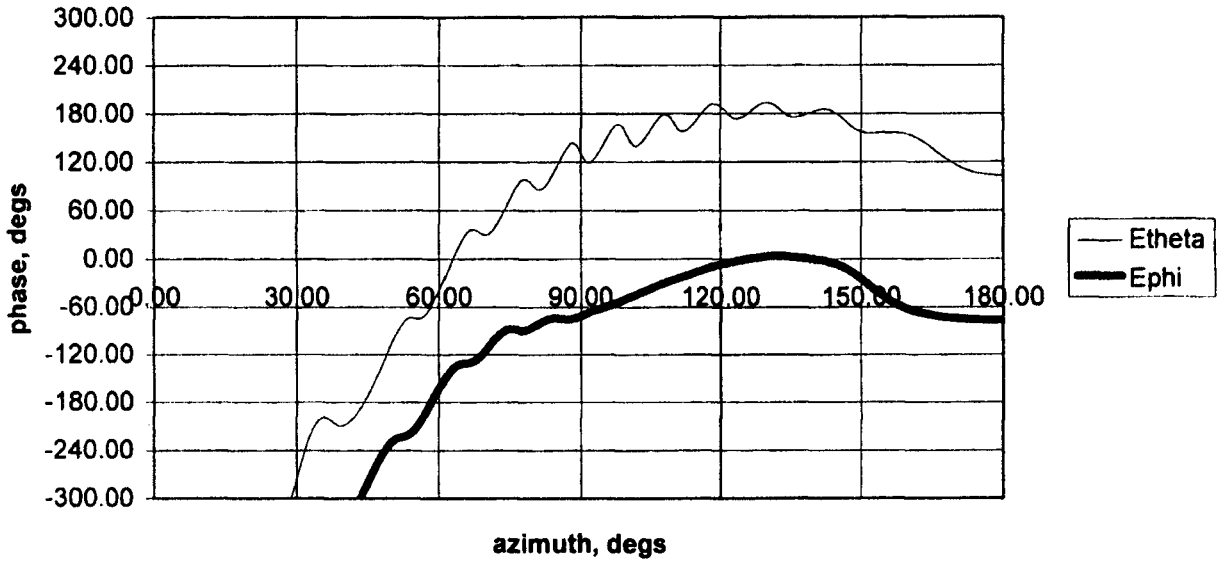
Fig. 2a: Prior Art Cone Design (F/D<0.2) typ.
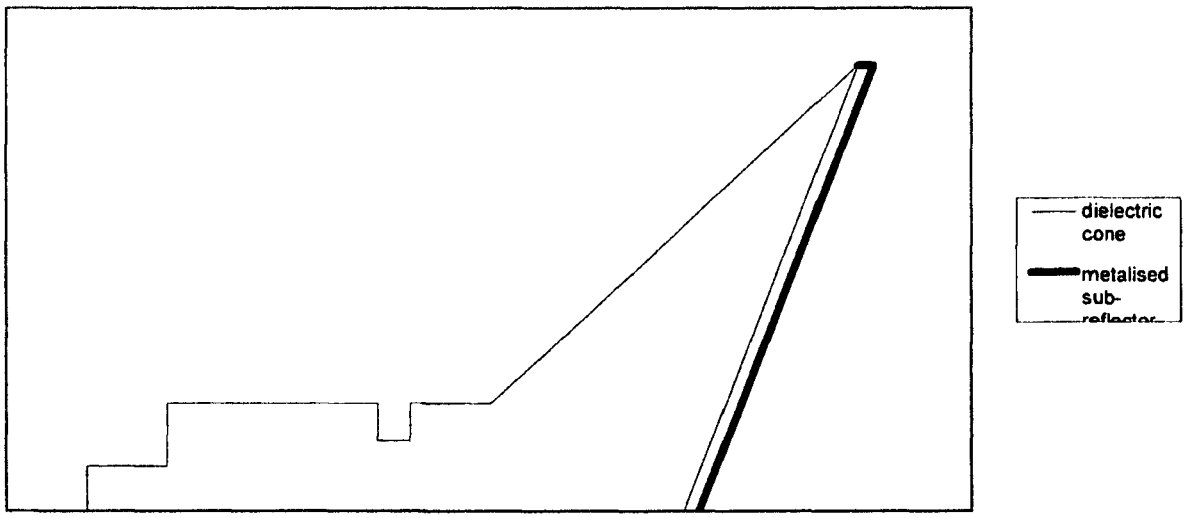

Fig. 2b: Etheta and EPhi Amplitude Radiation Patterns from Prior Art Cone Feed (F/D< 0.2 typ)
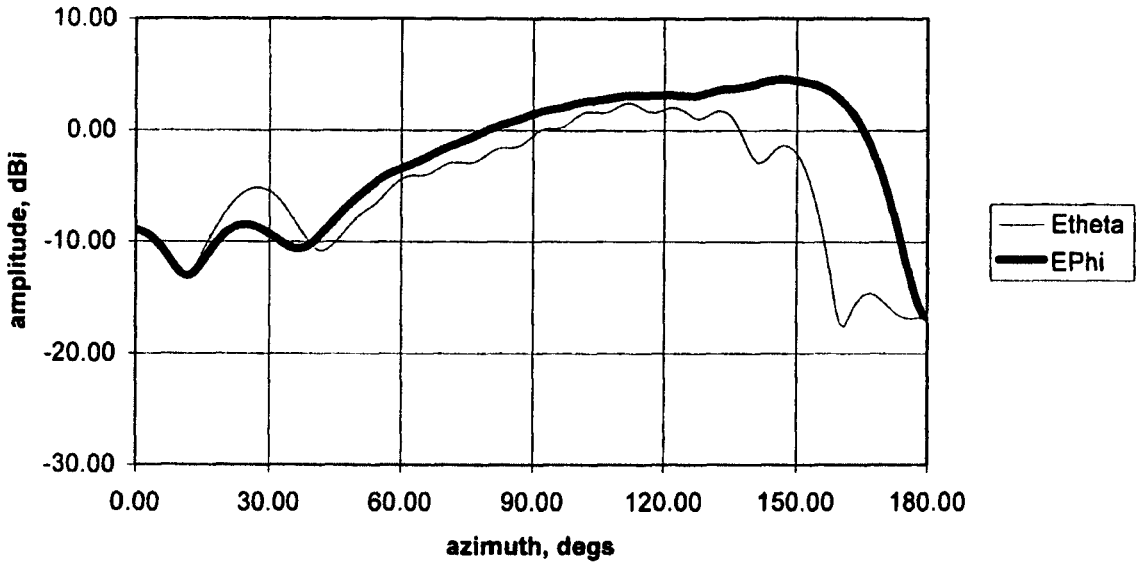
Fig. 2c: Etheta and Ephi Phase Patterns from Prior Art Cone Feed (F/D<0.2 typ)
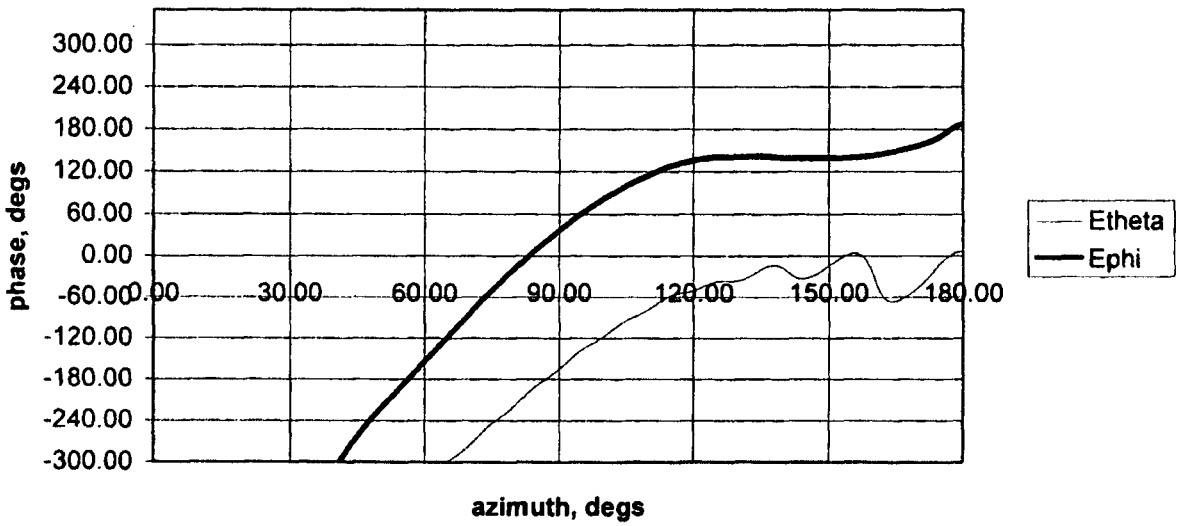

Fig. 3a: Prior Art Corrugated Cone Design (F/D<0.2) typ.
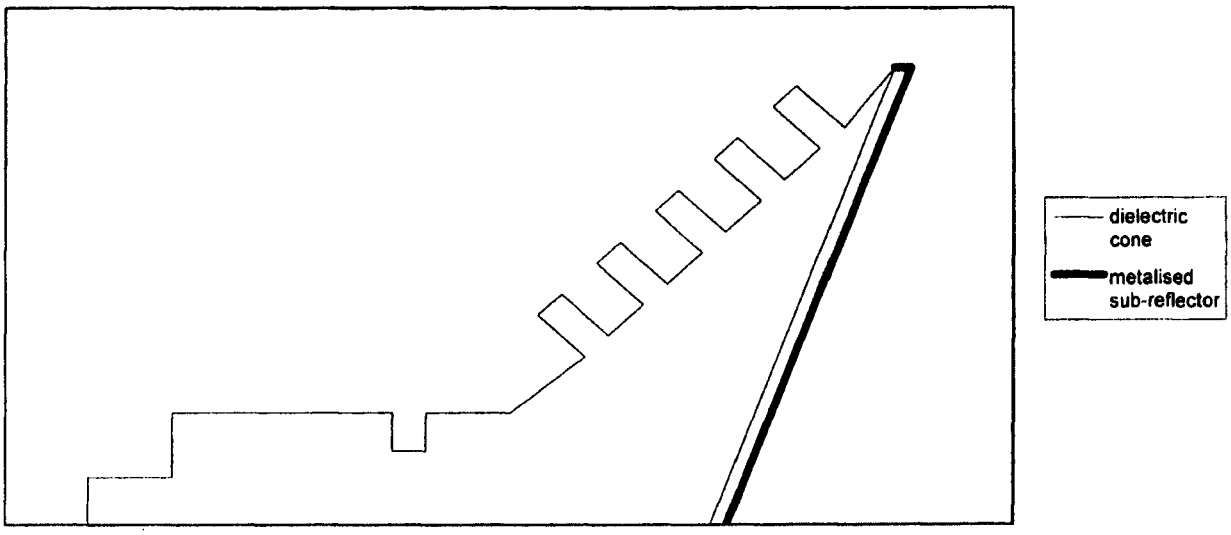
Fig. 3b: Etheta and EPhi Amplitude Radiation Patterns from Prior Art Corrugated Cone Feed (F/D< 0.2 typ)
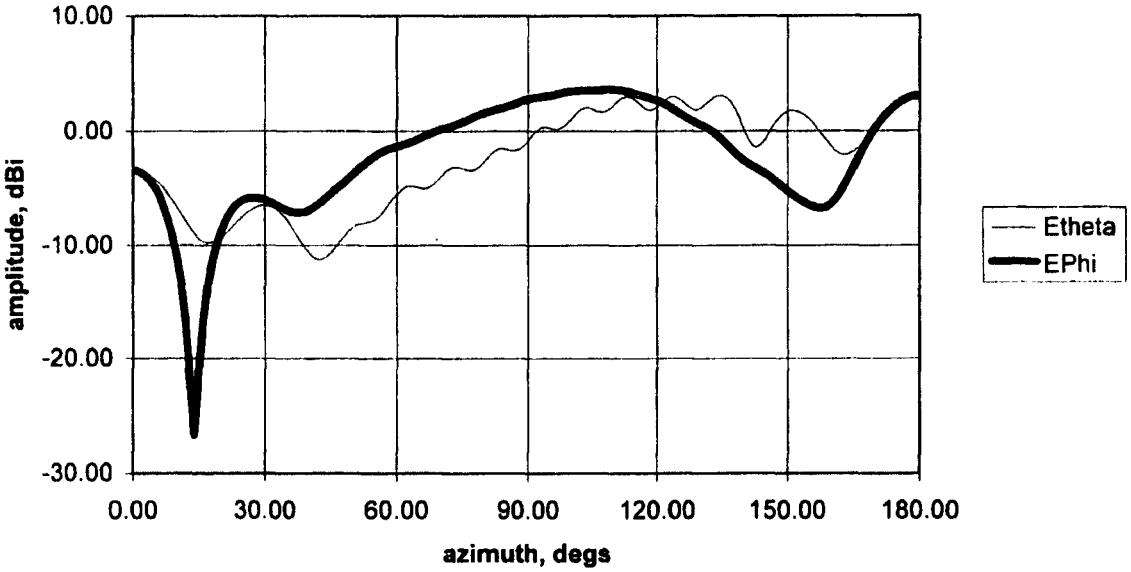

Fig. 3c: Etheta and Ephi Phase Patterns from Prior Art Corrugated Cone Feed (F/D<0.2 typ)
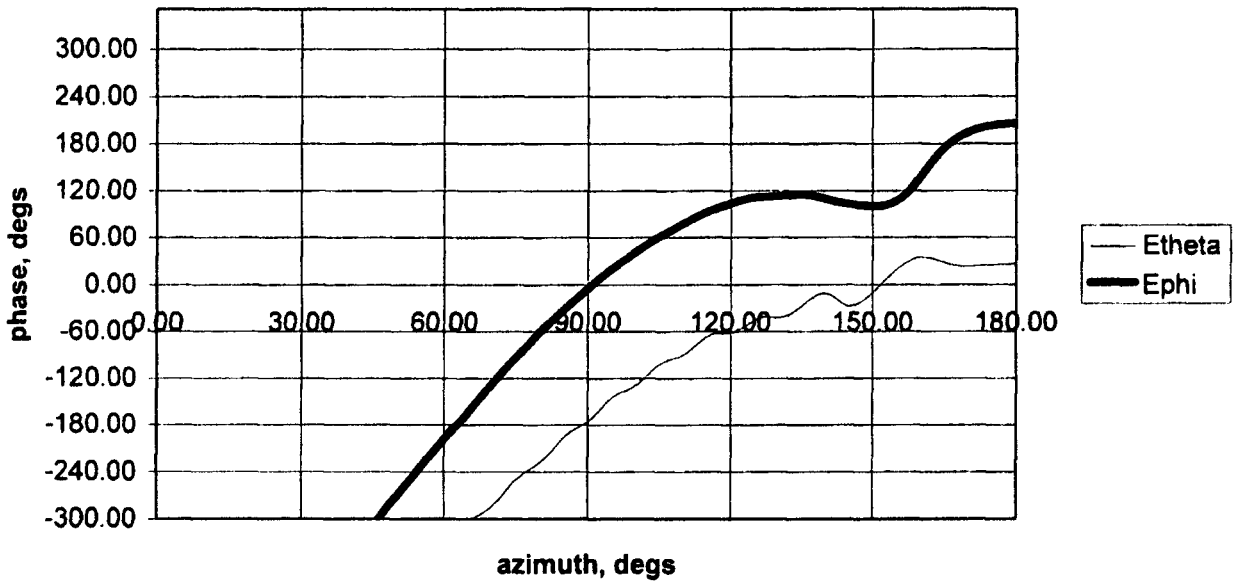

Fig. 6a: 22GHz 1' Measured Radiation Pattern of 1st Embodiment: E-plane vs ETSI and FCC specs
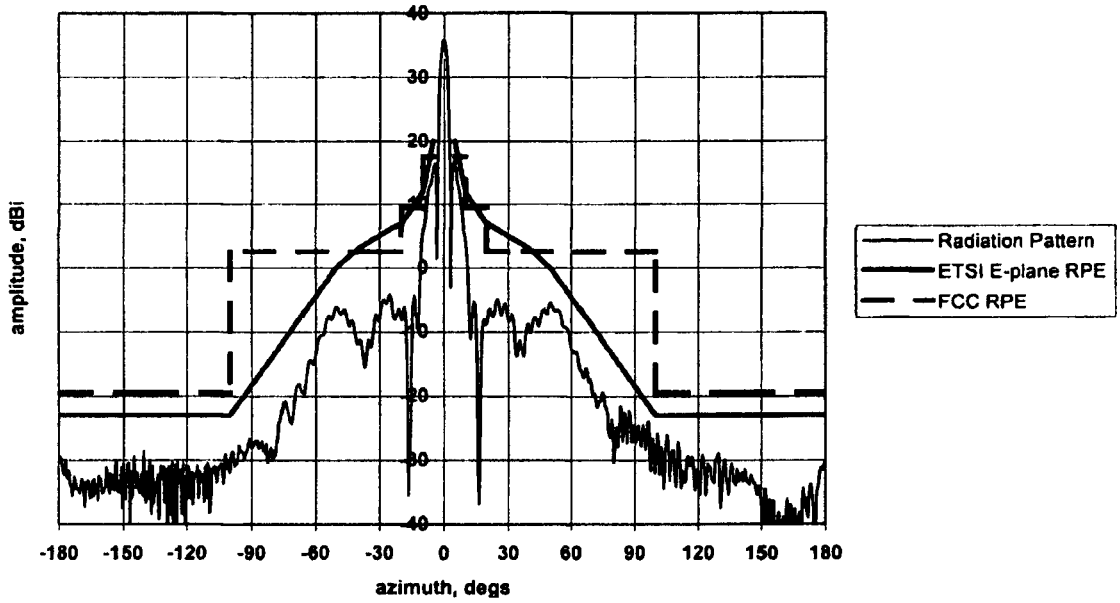
Fig. 6b: 22GHz 1' Measured Radiation Pattern of 1st Embodiment: H-plane vs ETSI and FCC specs
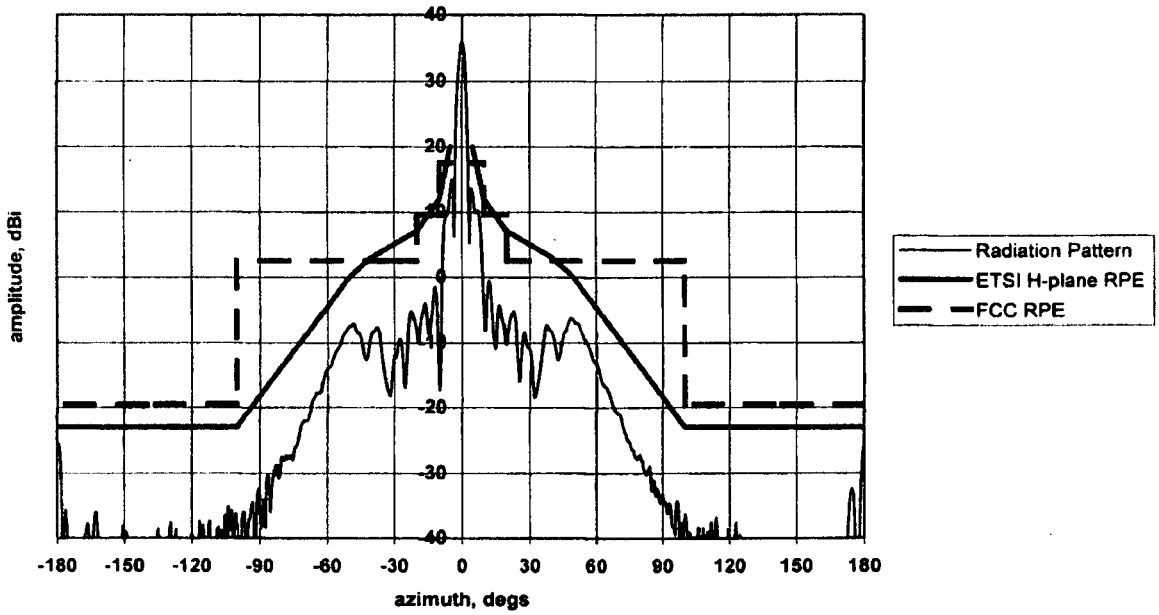

Fig. 7 of 1st Embodiment: Measured vs Modelled Return Loss of Cone Feed
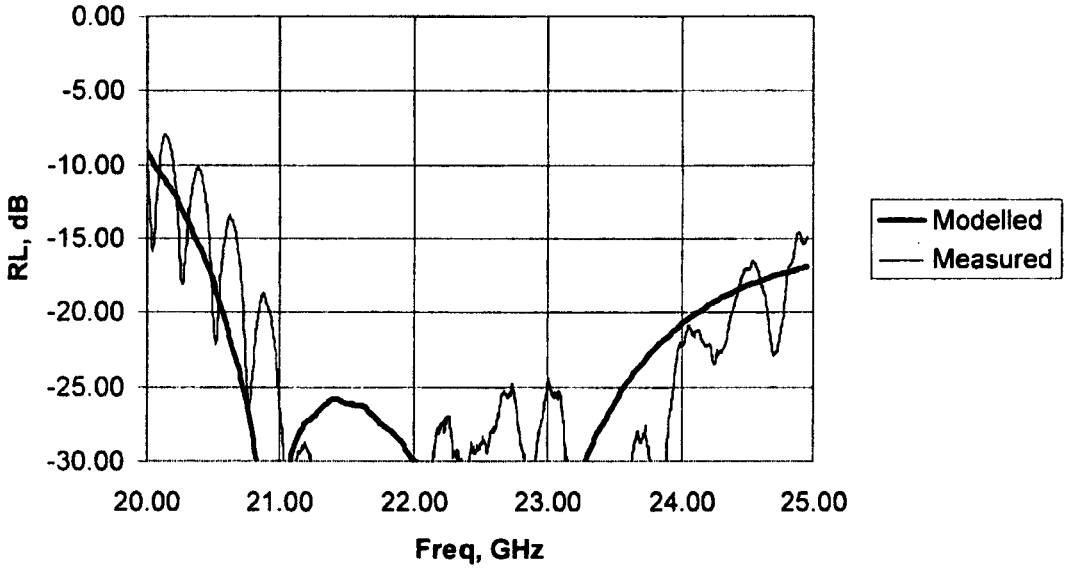

Fig. 9a: 22GHz 1' Measured Radiation Pattern of 2nd Embodiment: E-plane vs ETSI and FCC specs
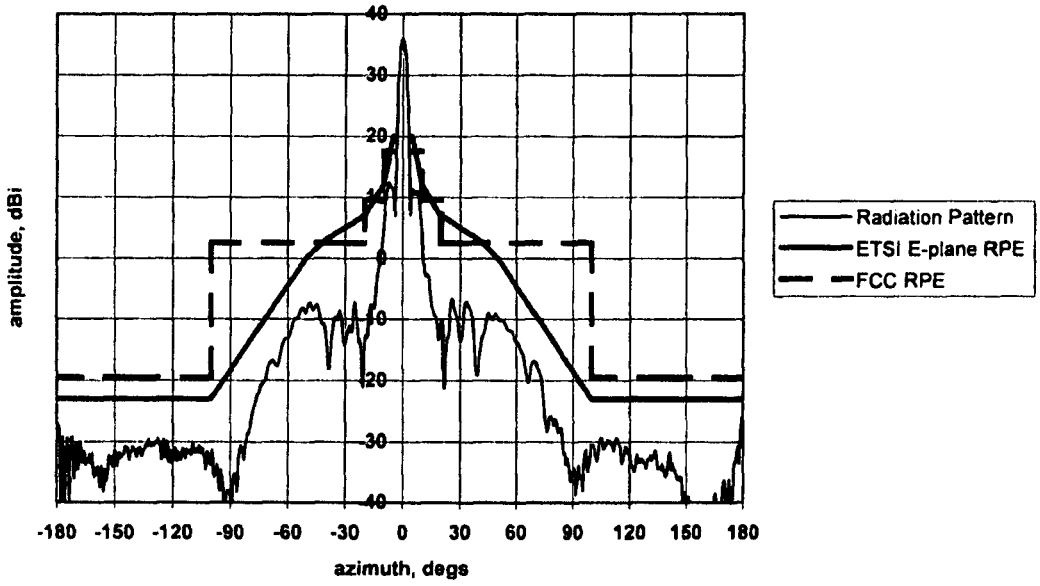
Fig. 9b: 22GHz 1' Measured Radiation Pattern of 2nd Embodiment: H-plane vs ETSI and FCC specs
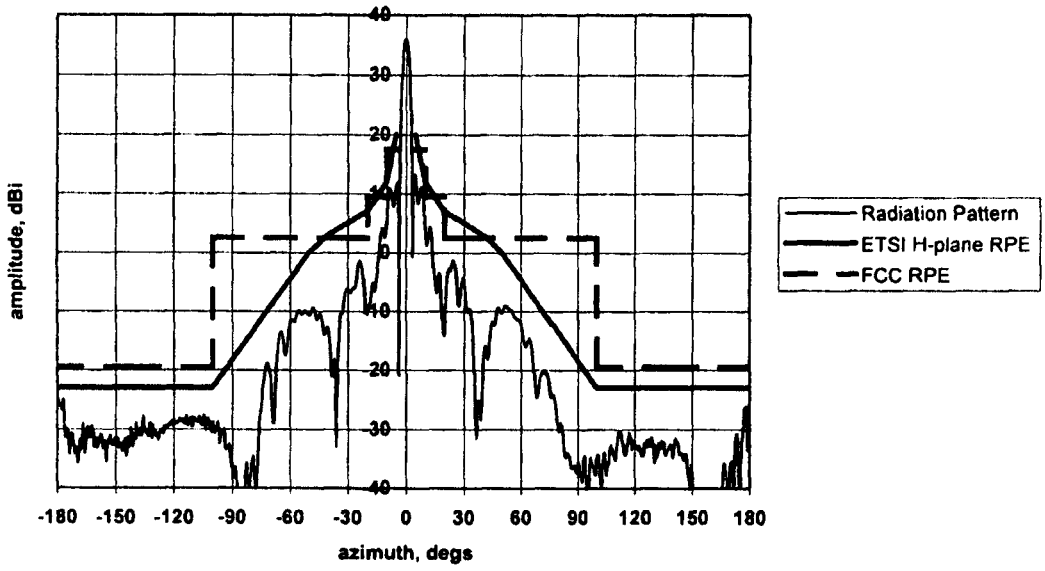

Fig. 10a: 3rd Embodiment (F/D<0.2) typ.
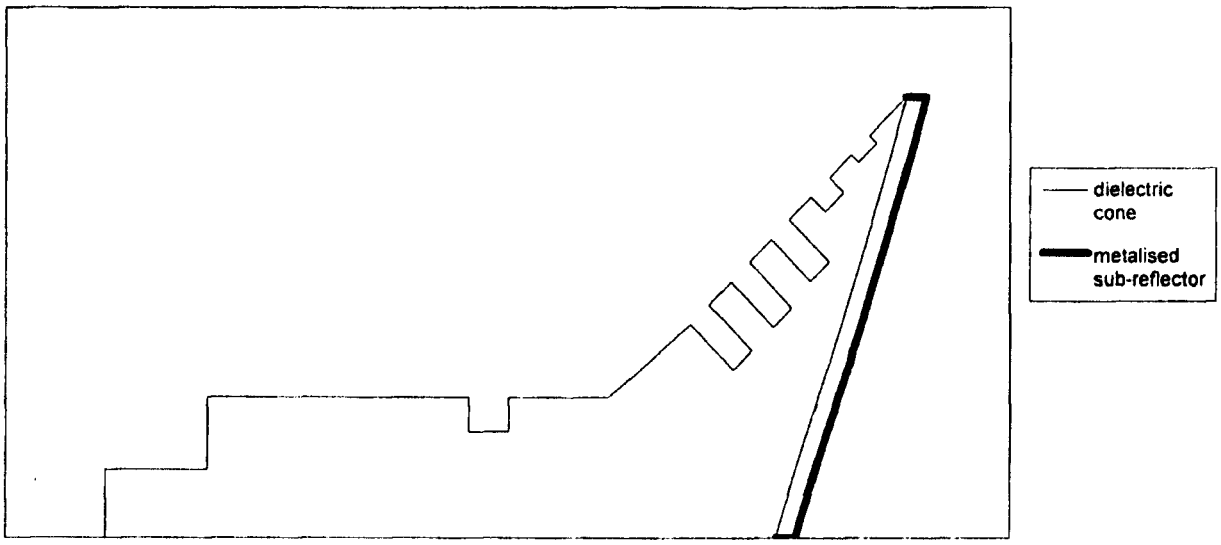
Fig. 10b: Etheta and EPhi Amplitude Radiation Patterns
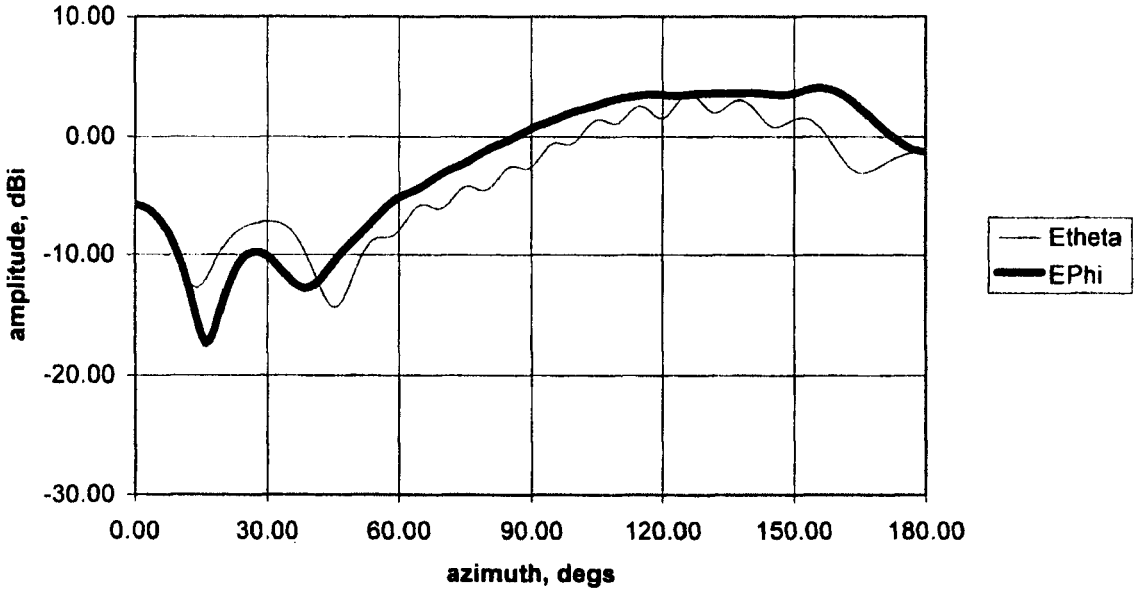

Fig. 10c:Etheta and Ephi Phase Patterns (F/D<0.2 typ)
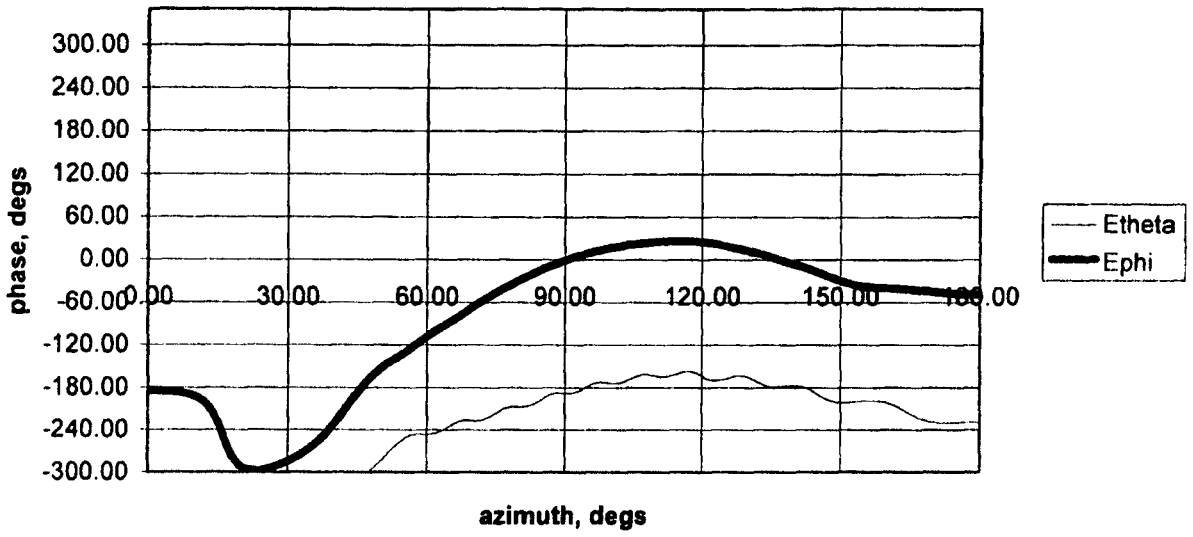
Fig. 11a: 4th Embodiment (F/D<0.2) typ.
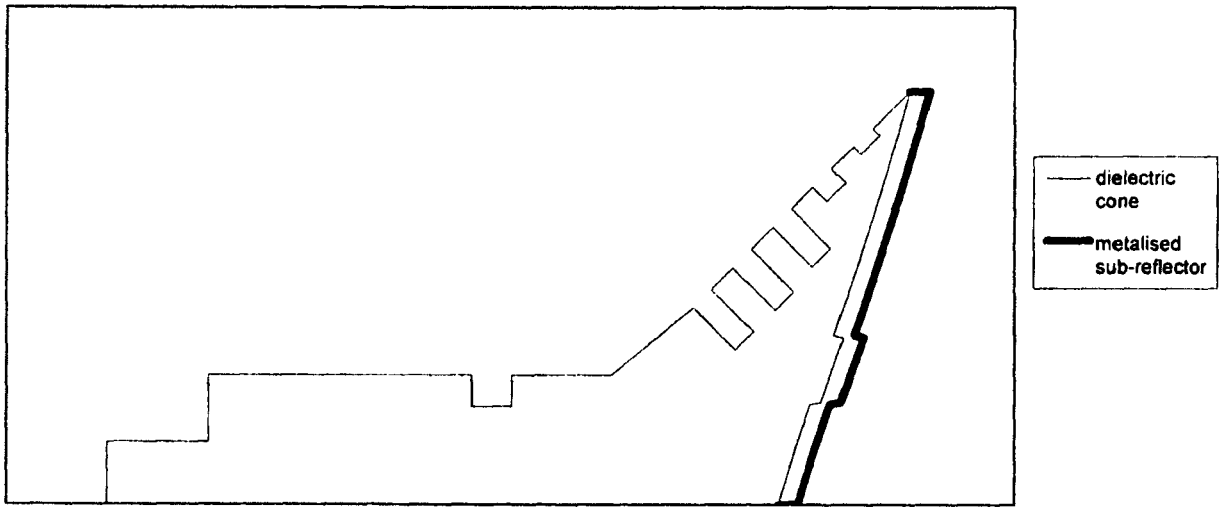

Fig. 11b: Etheta and EPhi Amplitude Radiation Patterns
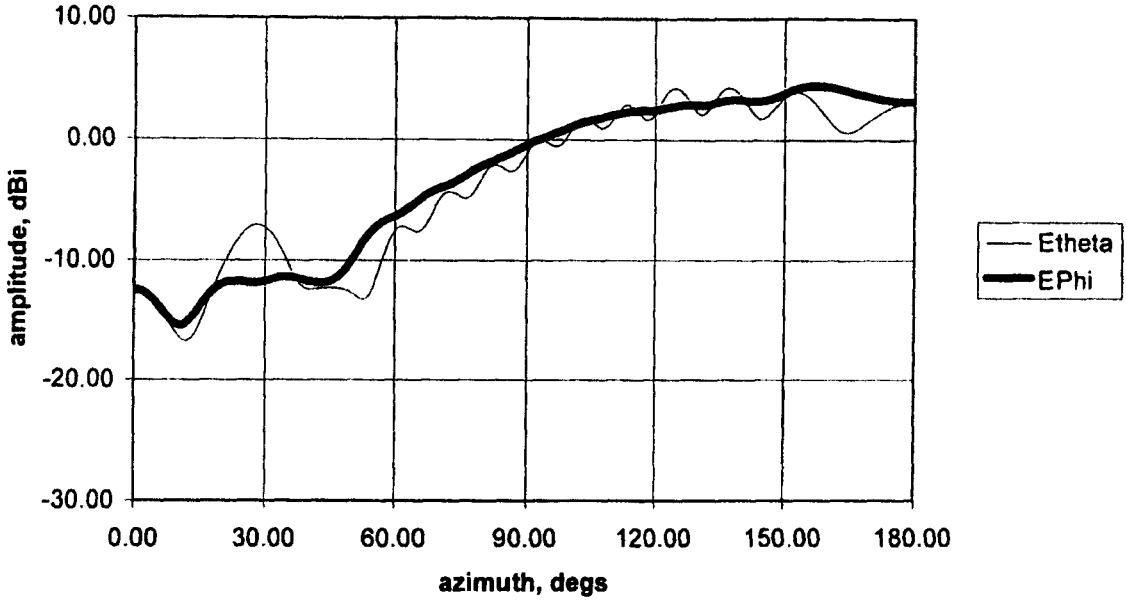
Fig. 11c: Etheta and Ephi Phase Patterns
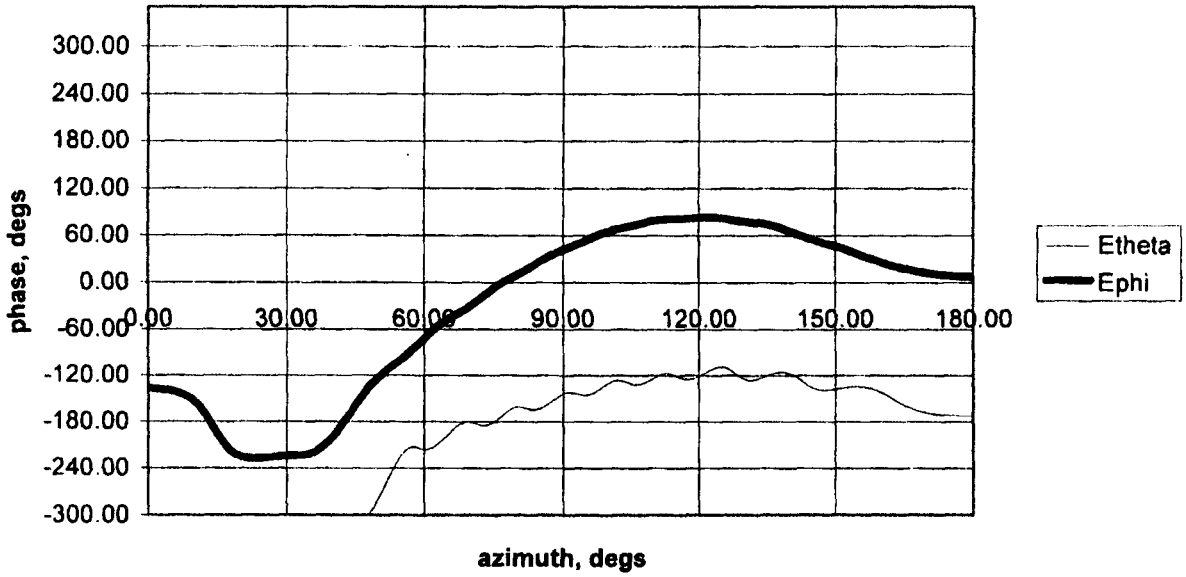

Fig. 12a: 5th Embodiment (F/D<0.2) typ.
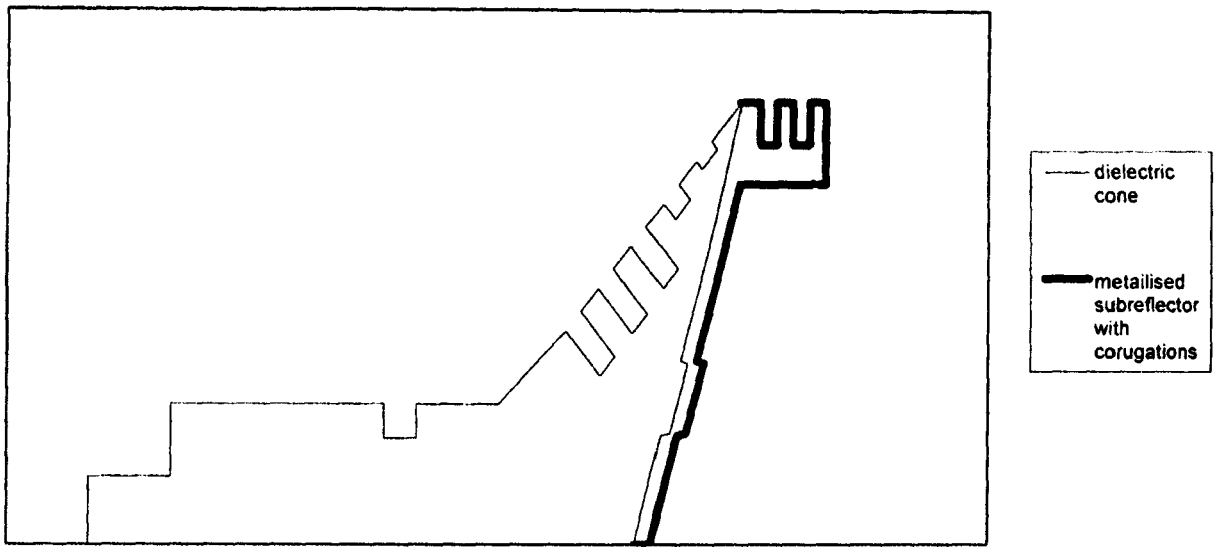
Fig. 12b: Etheta and EPhi Amplitude Radiation Patterns
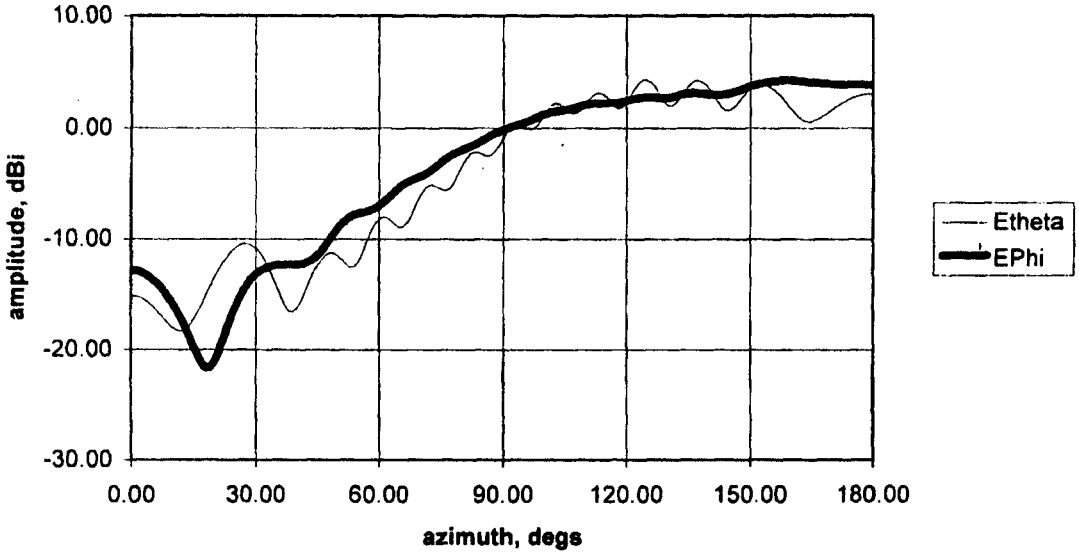

Fig. 12c: Etheta and Ephi Phase Patterns
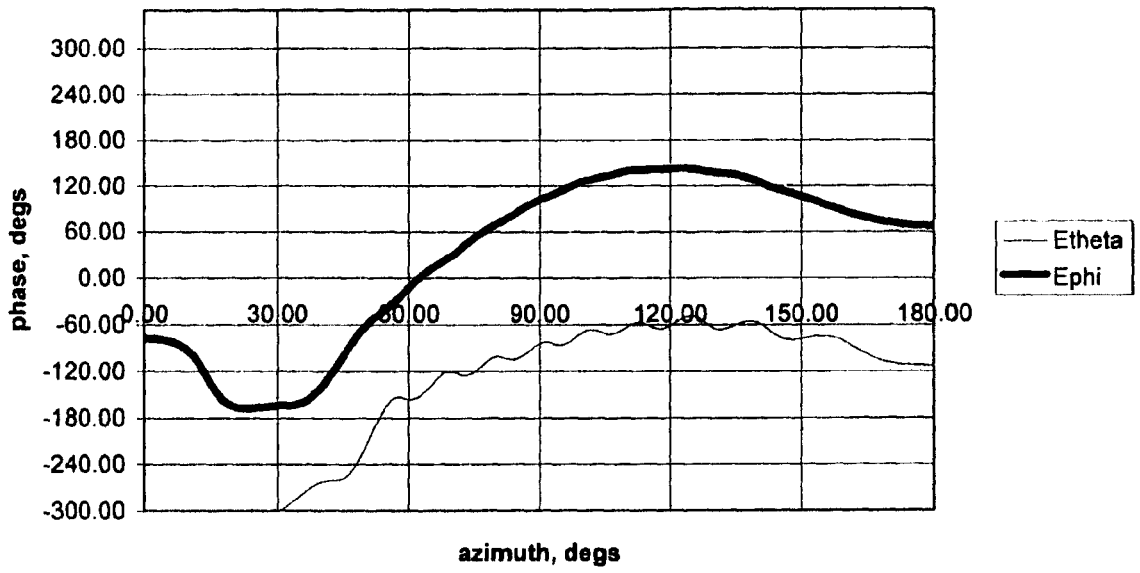
Fig. 13a: 6th Embodiment (F/D<0.2) typ.
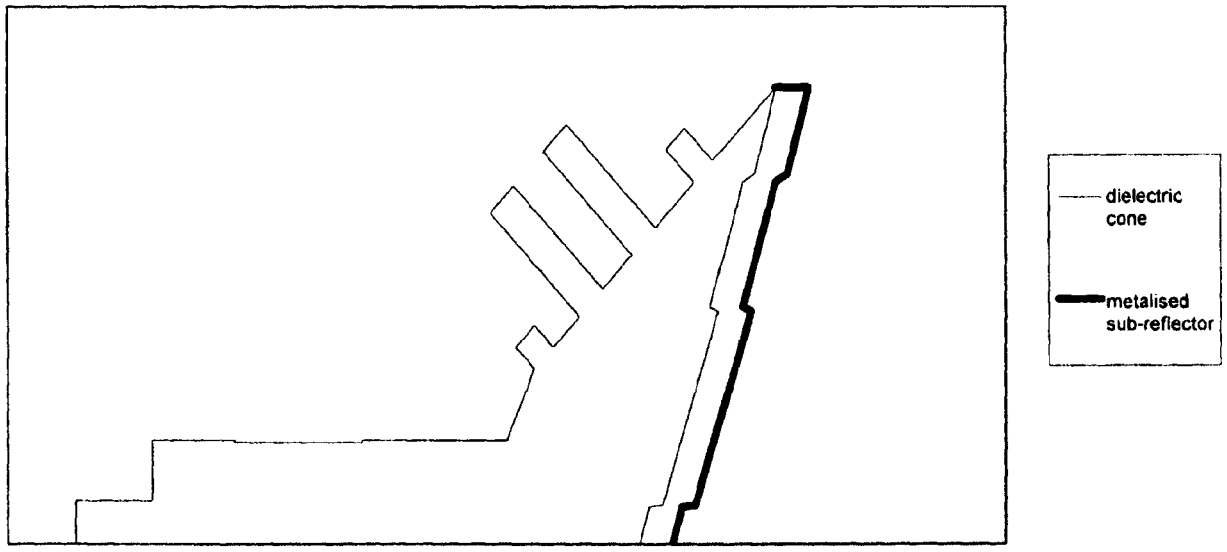

Fig. 13b: Etheta and EPhi Amplitude Radiation Patterns
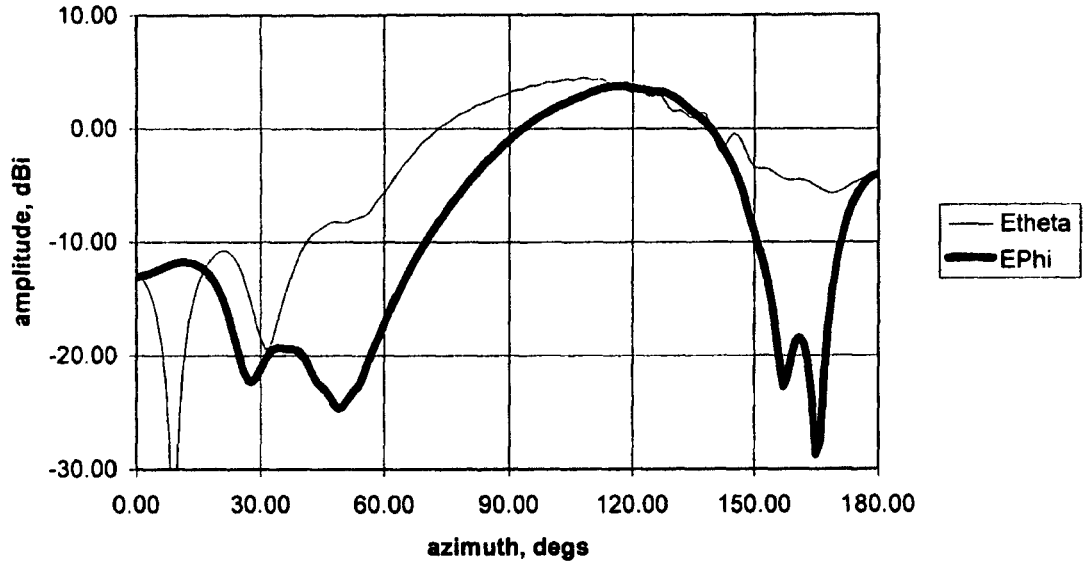
Fig. 13c: Etheta and Ephi Phase Patterns
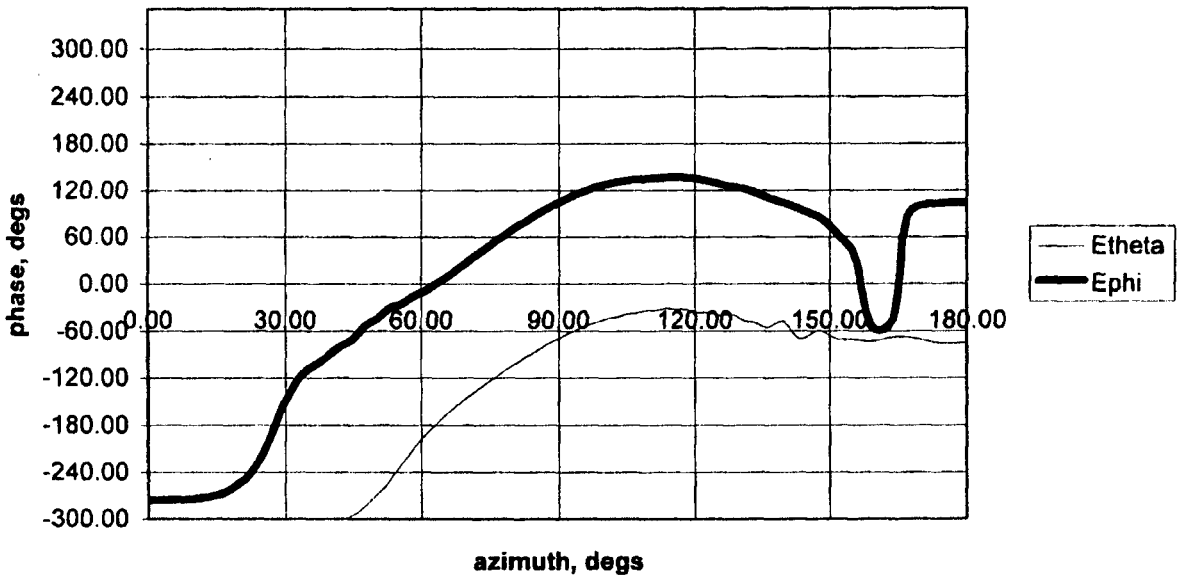

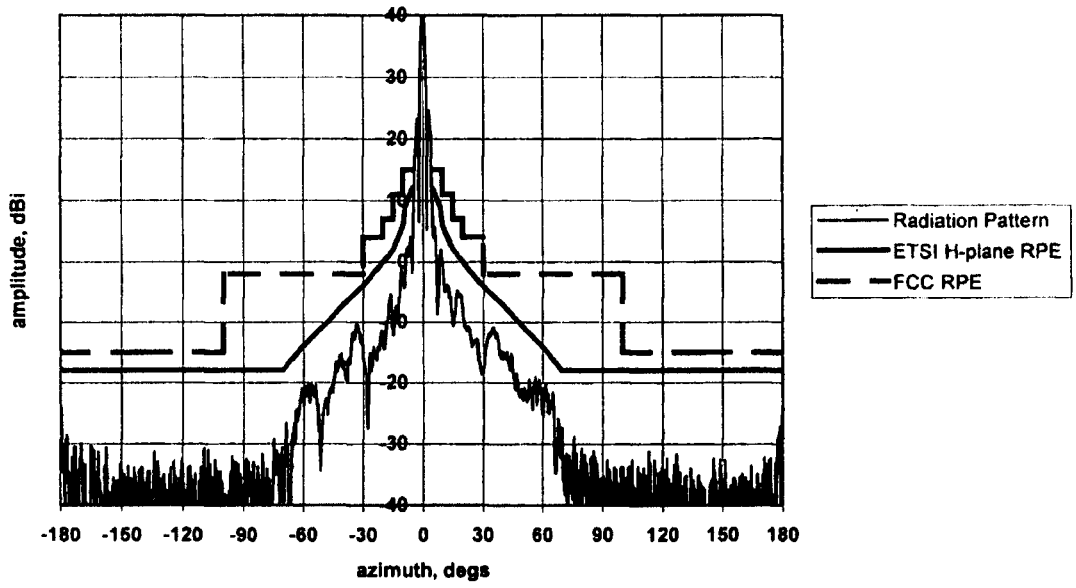

Fig. 13d: 38GHz 1' Measured Radiation Patterns of 6th Embodiment: E-plane vs ETSI and FCC specs
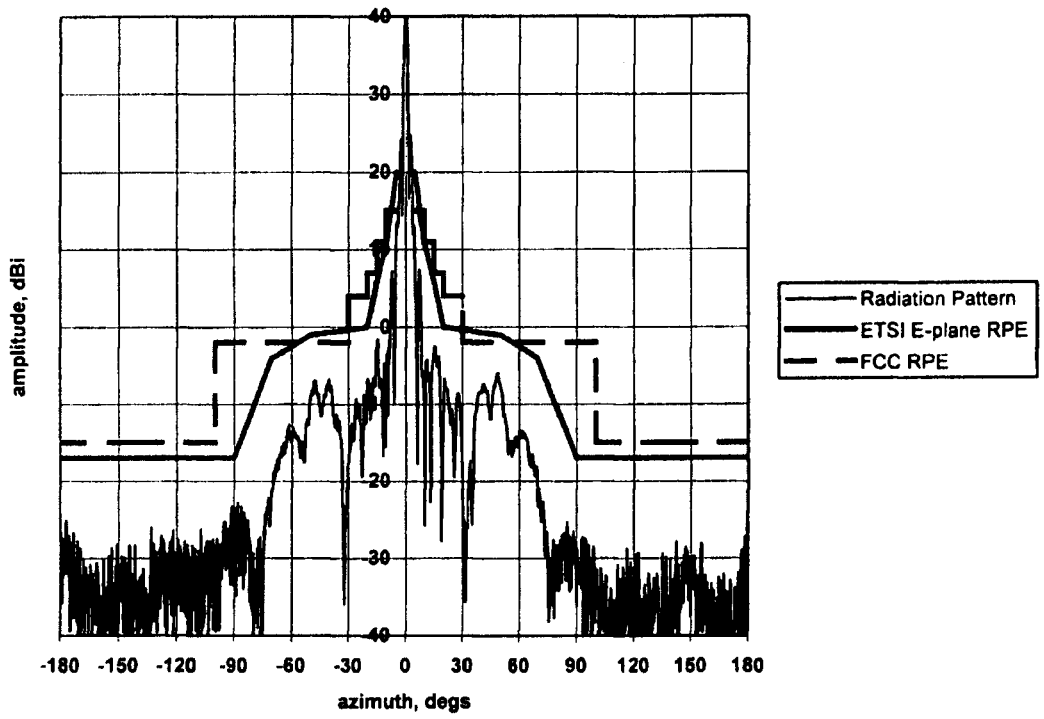
Fig. 13e: 38GHz 1' Measured Radiation Patterns of 6th Embodiment: H-plane vs ETSI and FCC specs